US006261055B1

(12) United States Patent
Owczarek

(10) Patent No.: US 6,261,055 B1
(45) Date of Patent: Jul. 17, 2001

(54) EXHAUST FLOW DIFFUSER FOR A STEAM TURBINE

(76) Inventor: Jerzy A. Owczarek, 2345 Overlook Dr., Bethlehem, PA (US) 18017-3738

( * ) Notice: Subject to any disclaimer, the term of this patent is extended or adjusted under 35 U.S.C. 154(b) by 0 days.

(21) Appl. No.: 09/366,478

(22) Filed: Aug. 3, 1999

(51) Int. Cl.[7] ..... F01B 25/02; F01D 1/02
(52) U.S. Cl. ..... 415/148; 415/211.2
(58) Field of Search ..... 415/208.1, 208.2, 415/210.1, 211.2, 148, 150

(56) References Cited

U.S. PATENT DOCUMENTS

| | | | | |
|---|---|---|---|---|
| 2,626,101 | * | 1/1953 | Curley | 415/211.2 |
| 3,406,632 | * | 10/1968 | DuPort et al. | 415/192 |
| 3,552,877 | * | 1/1971 | Christ et al. | 415/211.2 |
| 4,013,378 | * | 3/1977 | Herzog | 415/208.2 |
| 4,828,456 | * | 5/1989 | Bodzian et al. | 415/211.1 |
| 5,077,967 | * | 1/1992 | Widener et al. | 415/211.2 X |
| 5,209,634 | * | 5/1993 | Owczarek | 415/211.2 X |
| 5,257,906 | * | 11/1993 | Gray et al. | 415/211.2 X |
| 5,338,155 | * | 8/1994 | Kreitmeier | 415/211.2 |
| 5,518,366 | * | 5/1996 | Gray | 415/211.2 X |

FOREIGN PATENT DOCUMENTS

| | | | | |
|---|---|---|---|---|
| 44-5620 | * | 3/1944 | (JP) | 415/211.2 |

OTHER PUBLICATIONS

P.G. Hill, U.W. Schaub, Y. Senoo, Turbulent Wakes in Pressure Gradient, Transactions ASME, Journal of Applied Mechanics, vol. 85, Series E, pp. 518–524, Dec. 1963.

R.W. Fox, S.J. Kline, Flow Regimes in Curved Subsonic Diffusers, Transactions ASME, Journal of Basic Engineering, vol. 84, Series D, pp. 303–316, Sep. 1962.

J.R. Henry, C.C. Wood, S.W. Wilbur, Summary of Subsonic–Diffuser Data, NACA RM L56F05, 1956.

(List continued on next page.)

*Primary Examiner*—John E. Ryznic
(74) *Attorney, Agent, or Firm*—Charles A. Wilkinson

(57) ABSTRACT

An annular diffuser having its inlet located at the exit of a last row of blades of a steam turbine having initially very slowly increasing cross-sectional area with distance to accommodate the diffusion produced by the decaying wakes in the diffuser so as to prevent flow separation from diffuser walls and as a result to foster the diffusion process and to increase the efficiency of the steam turbine. The rate of increase of cross-sectional area, which is much smaller than that appropriate in diffusers having uniform incompressible flow at their inlets, allows wakes which form near the trailing edges of the last turbine blades to dissipate while avoiding flow separation. In the diffuser of this invention, whether it is one of fixed shape or one whose cross-sectional area can be changed by making use of an adjustable guide vane which surrounds at least a portion of the bearing cone, at a distance from inlet of one half of diffuser height at inlet, the cross-sectional area increase is smaller than 5.0% of the inlet cross-sectional area. This is equivalent to the corresponding two-dimensional straight-wall diffuser angle of, approximately, 2.9 degrees. For the diffuser whose cross-sectional area can be changed as required depending on its inlet flow conditions, the above limit applies for preferably most of the travel path of the adjustable guide vane but at least for the adjustable guide vane position closest to the turbine last blades. The length of the diffuser of this invention, in its preferred embodiment, measured along its mean line, is larger than or at least equal to 90% of the length of last turbine blades. The outer flow guide which defines the outer wall of the diffuser should have radius of curvature at its beginning larger than one half of the length of turbine last blades and should have a horizontal tangent there.

22 Claims, 5 Drawing Sheets-

OTHER PUBLICATIONS

G. Sovran, E.D. Klomp, Experimentally Determined Optimum Geometries for Rectilinear Diffusers with Rectangular, Conical or Annular Cross Section, in: Fluid Mechanics of Internal Flow, Elsevier Publishing Company, Amsterdam, Netherlands, 1967, (FIG. 17 on page 291, and Appendix B on pages 311 and 312).

J.H.G. Howard, A.B. Thornton–Trump, H.J. Henseler: Performance and Flow Regimes for Annular Diffusers, ASME Paper 67–WA/FE–21, 1967.

M. Ye. Deich, A. Ye. Zaryankin, Gas Dynamics of Diffusers and Exhaust Ducts of Turbomachines, translated by Foreign Technology Division, Wright–Patterson AFB, Ohio, report No. FTD–MT–24–1450–71. Available from Clearinghouse for Federal and Scientific Information, Springfield, VA, as report No. AD 745470, 1970.

Steam Turbines for Large Power Outputs, von Karman Institute for Fluid Dynamics, Lecture Series 1980–6, Rhode Saint Genese, Belgium, 586 pp., Apr. 21–25, 1980.

Y. Senoo, N. Kawaguchi, T. Kojima, M. Nishi: Optimum Strut Configuration for Downstream Annular Diffusers with Variable Swirling Inlet Flow, Transactions ASME, Journal of Fluids Engineering, vol. 103, pp. 294–298, Jun. 1981.

M.F. O'Connor, K.E. Robbins, J.C. Williams: Redesigned 26–inch Last Stage for Improved Turbine Reliability and Efficiency, Paper presented at the ASME/IEEE Joint Power Generation Conference, Sep. 17, 1984, Toronto, Ontario, Canada.

B.K. Sultanian, S. Nagao, T. Sakamoto: "Experimental and Three–Dimensional CFD Investigation in a Gas Turbine Exhaust System," Transaction ASME, Journal of Engineering for Gas Turbines and Power, vol. 121, pp. 364–374, Apr. 1999.

D.G. Wilson, "The Design of High–Efficiency Turbomachinery and Gas Turbines" MIT Press, Cambridge, Massachusetts 1984, Chapter 4, pp. 147–187.

* cited by examiner

EXHAUST FLOW DIFFUSER FOR A STEAM TURBINE

BACKGROUND OF THE INVENTION

1. Field of the Invention

This invention relates to steam turbines and more particularly to annular diffusers for the exhaust from such turbines. More particularly still, this invention relates to annular flow diffusers located at the exit from condensing steam turbines, such diffusers being defined in most cases by an outer flow guide and, for the most part, either a separate inner flow guide or a bearing cone beginning immediately after the last row of turbine blades and ending at the location of the entrance of the exhaust steam into the main structure of the exhaust hood. The inner or outer flow guides, or both, may be adjustable guide vanes.

2. Description of the Prior Art

In condensing steam turbines used in power generation, steam leaving the last row of turbine blades flows, generally, through an annular outwardly flared passage, known as a diffuser, positioned between the turbine enclosure, or casing, and the exhaust hood proper. Such diffuser is defined by an outwardly flared flow guide extending from the turbine casing, to which it is customarily fastened, for 360 degrees circumferentially about the turbine shaft, and an inner flow guide formed at least in part by the outer surface of the bearing cone or in some cases a separate flow guide, or in case of steam turbines equipped with an adjustable guide vane which at least partially surrounds the bearing cone, mainly by the outer surface of the adjustable guide vane. The steam passes from the diffuser into the body of a collector or "exhaust hood" and subsequently discharges from the exhaust hood into a condenser. The most prevalent type of exhaust hood is one located directly above the condenser, or a "downward-discharging" exhaust hood.

The so-called "diffuser" located between the exit from the last turbine blades and the exhaust hood per se is customarily formed from two annular surfaces which guide the exhausting steam from the turbine itself into the exhaust hood, meanwhile, in well-designed diffusers, because of its increasing cross-sectional areas, diffusing, or decelerating, the exhaust steam passing therethrough. This deceleration causes a decrease in the kinetic energy of the steam plus an increase in pressure, the net effect being that the inlet to the diffuser assumes the lowest pressure of the path from the turbine to the condenser so that the steam exhausts from the last turbine blades into a minimum pressure zone thus increasing the velocity of steam flowing through the blades and increasing the energy available to the turbine to do work.

In a typical arrangement, as indicated above, the upper surface of the bearing cone, or of the adjustable guide vane as the case may be, constitutes most of or the entire inner annular surface of the diffuser and the inner surface of an outer flow guide constitutes the outer annular surface having the overall contour or configuration necessary to direct steam into the exhaust hood. The length of a downward-discharging exhaust hood, measured along the axis of a steam turbine, is limited by the bearing span of the turbine. As a result, steam leaving the last row of blades of a turbine must have its direction changed from mainly horizontal to essentially vertical in a relatively short distance which varies about the circumferential extent of the diffuser, but is relatively short at all points. This places a limit on the length of the diffuser located at the turbine exit, since it is inadvisable to have sharp turns in a diffuser such as might be necessary particularly at the top of the turbine in order to extend the diffuser, because sharp turns are known to cause flow separation with resultant eddies and energy losses. In steam turbines built in the U.S.A. the ratio of the length of the diffuser to its height at inlet is customarily quite small, usually being close to one, and often even smaller. To produce a certain amount of diffusion, turbine designers build diffusers having rather large (inlet-to-exit) area ratios. Such designs are, in general, based on information available from studies of flow in diffusers having uniform and incompressible flow at the inlet.

It is desirable to have a large amount of diffusion, or pressure rise, in a diffuser of a steam turbine, because, for any given condenser pressure, there is then produced a lower pressure at the entrance to the diffuser and thus at the exit from the last row of turbine blades, thus increasing the energy available to the turbine to do work and also improving performance of the last row of blades when condenser pressure is higher than the pressure assumed in design of the turbine, thus increasing turbine efficiency. The amount of diffusion a diffuser can produce, however, is limited by the (longitudinal) pressure gradient, the average overall pressure gradient being the ratio of the pressure rise to the length of the diffuser. Such pressure rise in turn depends on the exit-to-inlet area ratio of the diffuser. If the pressure gradient becomes too large, i.e. the walls of the diffuser diverge to steeply, the steam flow will become separated from the walls of the diffuser and the amount of diffusion can be seriously reduced or even entirely eliminated.

Since a diffuser in a bottom condensing steam turbine is of necessity short relative to its height at its inlet, if it is not to be sharply curved, the amount of diffusion which it can produce is, therefore, correspondingly limited. This is especially so for diffusers in which the flow over a large portion is in predominantly an axial direction, that is, in the direction of the axis of the turbine, which as explained is usually desirable.

The flow entering a diffuser located downstream from a last blade row of a turbine has many wakes in it, these being necessarily formed at the trailing edges of blades by the deceleration of flow passing closely to the blade surfaces. Such wakes can be produced by both fixed blades of the turbine and the rotating blades (as well as shrouds on the blades plus any supporting struts interposed in the flow, or tie- or lacing-wires, if any). It is the wakes from the last rotating blades that exert most influence on the flow in the diffuser, any prior wakes having been largely dispersed into the general flow by such terminal blades. Each moving blade provides a wake, i.e. in the typical large turbine, as many as a hundred or more wakes are present. In this respect the actual flow in a diffuser located downstream of a condensing steam turbine differs from the rather thoroughly studied and relatively well understood diffuser flow in which flow at the inlet to the diffuser is uniform. In steam turbines these wakes are especially thick when the turbine operates at condenser pressures higher than the design condenser pressure because under such conditions the boundary layer flow passing over and from the surfaces of the last turbine blades is either on the verge of separation or is partially separated from the blade surfaces.

3. Description of Related Art

The following prior articles contain discussions or disclosures of phenomena and considerations having a bearing upon the present invention.

1. P. G. HILL, U. W. SCHAUB, Y. SENOO: "Turbulent Wakes in Pressure Gradient," Transactions ASME, Journal of Applied Mechanics, vol. 85, Series E, pp.518–524, December 1963.

2. R. W. FOX, S. J. KLINE: "Flow Regimes in Curved Subsonic Diffusers" Transactions ASME, Journal of Basic Engineering, vol. 84, Series D, pp. 303–316, September 1962.

3. J. R. HENRY, C. C. WOOD, S. W. WILBUR: "Summary of Subsonic-Diffuser Data," NACA RM L56F05, 1956.

4. G. SOVRAN, E. D. KLOMP: "Experimentally Determined Optimum Geometries for Rectilinear Diffusers With Rectangular, Conical or Annular Cross Section," in: Fluid Mechanics of Internal Flow, Elsevier Publishing Company, Amsterdam, Netherlands, 1967, (FIG. 17 on page 291, and Appendix B on pages 311 and 312).

5. J. H. G. HOWARD, A. B. THORNTON-TRUMP, H. J. HENSELER: "Performance and Flow Regimes for Annular Diffusers," ASME Paper 67-WA/FE-21, 1967.

6. M. Ye. DEICH, A. Ye. ZARYANKIN: "Gas Dynamics of Diffusers and Exhaust Ducts of Turbomachines," translated by Foreign Technology Division, Wright-Patterson AFB, Ohio, report No. FTD-MT-24–1450–71. Available from Clearinghouse for Federal and Scientific Information, Springfield, Va., as report No. AD 745470, 1970.

7. "Steam Turbines for Large Power Outputs," von Karman Institute for Fluid Dynamics, Lecture Series 1980–6, Rhode Saint Genese, Belgium, 586 pp., Apr. 21–25, 1980.

8. Y. SENOO, N. KAWAGUCHI, T. KOJIMA, M. NISHI: "Optimum Strut Configuration for Downstream Annular Diffusers With Variable Swirling Inlet Flow," Transactions ASME, Journal of Fluids Engineering, vol. 103, pp.294–298, June 1981.

9. M. F. O'CONNOR, K. E. ROBBINS, J. C. WILLIAMS: "Redesigned 26-inch Last Stage for Improved Turbine Reliability and Efficiency," Paper presented at the ASME/IEEE Joint Power Generation Conference, Sep. 17, 1984, Toronto, Ontario, Canada.

10. J. A. OWCZAREK: "Fundamentals of Gas Dynamics," International Textbook Company, Scranton, Pa., 1964.

11. B. K. SULTANIAN, S. NAGAO, T. SAKAMOTO: "Experimental and Three-Dimensional CFD Investigation in a Gas Turbine Exhaust System", Transactions ASME, Journal of Engineering for Gas Turbines and Power, vol. 121, pp. 364–374, April 1999.

In particular the 1963 Hill et al. article from the Transactions of the ASME describes a study of turbulent wakes in pressure gradients in a two-dimensional diffuser. The study concludes generally that, if a very large pressure gradient is present, a wake may even grow rather than decay, and provides a suggested criterion, i.e. restriction of the pressure gradient of the diffuser, which should be satisfied in order to prevent growth of wakes. The Fox and Kline article discusses flow regimes in a curved diffuser having a rectangular cross section and circular arc center line with uniform inlet flow and presents, in the form of a graph, lines locating the first appreciable stall line as a function of turning angle. The third article by Henry et al. gives a summary of information on performance of diffusers with subsonic uniform flow at the inlet, and the fourth article by Sovran et al. describes an extensive experimental study of such flows. The fifth article by Howard et al. discusses performance and flow regimes for annular diffusers with uniform flow at their inlets. The report by Deich and Zaryankin describes various studies made in the Soviet Union with respect to conical, annular and axi-radial diffusers with uniform inlet flow and of various exhaust hood designs. The seventh report issued by the von Karman Institute discusses, in general, large steam turbines and gives a comparison of the optimal geometry for two-dimensional, conical and straight-core annular diffusers with uniform inlet flow. The eighth article by Senoo et al. describes the only known study on the pressure recovery of three (straight core) annular diffusers without any splitter vanes inside in a model in which tests were run with and without (two or four) struts placed just upstream of diffuser inlet, and therefore with and without wakes at the inlet, with and without swirl in the flow. Attention was directed during the investigation toward finding the best strut configuration and orientation, but not toward the effect of wakes on diffuser performance. The ninth article by O'Connor et al. discusses redesign of the last stages of turbines, while the tenth, a book by the present inventor, deals with equations of gas dynamics. The final, and most recent literature reference known to the present inventor, namely the eleventh article by Sultanian et al. is concerned with an experimental and computational study of flow in a straight core annular diffuser for a gas turbine with struts located inside and about half-way through the diffuser (these struts produced wakes but not at the diffuser inlet because they were located approximately at the middle of the diffuser length) plus guide vanes located a relatively long distance upstream of the diffuser to produce swirl in the flow. The diffuser, which modeled "one of the most complex designs in the existing product line" was provided with turning vanes at the diffuser exit. It had a wall angle of about 8 degrees, and a corresponding two-dimensional straight-wall diffuser angle of about 5 degrees. The attention of the study was focused on a comparison between the experimental results and three-dimensional CFD predictions. The measured total pressure loss in the diffuser was found to be higher than predicted. The flow in the initial length of the diffuser was almost uniform because the guide vanes which produced swirl in the flow were placed a very significant distance upstream of the diffuser inlet with a long annular passage of constant cross-sectional area in-between, and, as has already been stated, the struts were placed within the diffuser and not at the inlet. As a result, the inlet flow to the diffuser was uniform, or nearly so, and this study did not shed any light on the effect of wakes in the inlet flow on the flow in the diffuser.

Estimates made using illustrations of exhaust flow annular diffusers of large steam turbines presented in various publications from the late 1960's until early 1990's have provided the following information: the estimated corresponding two-dimensional straight-wall diffuser angles of turbines made by domestic manufacturers determined at a distance of one half of the diffuser height at inlet along a diffuser mean line fall in the range of 6.5 degrees to 16.5 degrees, with the corresponding rates of diffuser cross-sectional area increase being in the range of from 11% to 30%. For the Siemens/KWU turbines the corresponding numbers are from 4.63 degrees to 8.0 degrees, and 8.1% to 14% for the recent (ca. 1988) units, and 11 degrees and 21% for the older units from 1960's to early 1970's. For a Brown Boveri large steam turbine from the 1970's the corresponding values are 5.5 degrees and 9.6%.

There is no published study which would indicate what, if anything, should be done to compensate for wakes in the exhaust steam entering a diffuser, namely if any limit should be placed on the rate of increase of diffuser cross-sectional area, so that the diffuser and turbine performance could be improved in a flow with wakes in it.

There has been a need, therefore, for a method of design and construction of diffusers for steam exhaust from the low pressure stage in steam turbines, which method and construction will, as a practical matter, allow effective diffusion of the exhaust flow from such steam turbine by taking into account the effect of the wakes, inherent in such exhaust flow as a result of flow around blade surfaces, on the diffusion process in the diffuser.

The present inventor has determined through physical and mathematical modeling and analysis details of which are provided in the attached Appendix that the process of decay of wakes in the flow in a diffuser produces on its own a certain amount of diffusion of the fluid flow, and therefore also a pressure gradient, which adds to that which results from the increase of the diffuser cross-sectional area. In order to maintain the magnitude of the pressure gradient the same as in the case of a flow with uniform velocity at the inlet having an optimal amount of diffusion so as to avoid flow separation from the walls of the diffuser, the rate of increase of the diffuser cross-sectional area must in accordance with the invention be correspondingly smaller.

OBJECTS OF THE INVENTION

It is a prime object of this invention to maximize the amount of work or power delivered by a steam turbine operating at any given condenser pressure by lowering the pressure at the exit of the last row of turbine blades.

It is a further object of the invention to provide a diffuser for an exhaust hood which will not induce permanent flow separation from the walls of the diffuser which would inevitably cause increased turbulence, increased pressure at the turbine exit and thereby decrease the amount of power produced by the turbine.

It is a still further object of the invention to provide a diffuser that will induce the lowest pressure possible at its inlet, while overcoming the effect of wakes in the exhaust steam flow.

It is still a further object of the invention to account for the effects or wakes naturally occurring in steam passing from turbines through diffusers on the diffusion process in the diffuser.

It is a still further object of the invention to provide a diffuser having parameters that will account for the effect of compressibility of steam passing through such diffuser.

It is a still further object of the invention to provide a diffuser having a limit placed on the rate of increase of its cross-sectional area in the initial portion of the diffuser.

It is a still further object of the invention to provide a diffuser in the exhaust end of a steam turbine in which the outer flow guide which defines the outer surface of the diffuser has at its beginning a radius of curvature larger than one half of the length of turbine last blades coupled with a limited area increase in the initial portion of the diffuser.

It is a still further object of this invention to provide diffuser geometries which will account for the presence of wakes in the steam passing through steam turbines in general use today both in exhaust flow diffusers having fixed geometries as well as in steam turbines which utilize adjustable flow guide vanes which surround at least a portion of the bearing cone, and in which diffuser cross-sectional areas can be changed in response to changing exhaust flow conditions.

It is a still further object of this invention to provide a diffuser for steam exiting from a steam turbine the geometry and parameters of which account for the presence of wakes in the steam derived from the last blades of the turbine by limiting the initial rate of increase of the cross-sectional area of the diffuser which has a length of at least 90% of the length of the last blades of the turbine.

It is a still further object of the invention to limit the increase in the cross-sectional area of a diffuser in the initial portion of the diffuser equal to approximately half the length of the last blades of the turbine to not more than 5.0% of the inlet cross-sectional area equivalent to a two-dimensional straight wall diffuser angle of 2.9 degrees or less.

Additional objects and advantages of the present invention will become evident from review of the following specifications and appended drawings.

SUMMARY OF THE INVENTION

The process of decay of wakes inherent in the exhaust flow diffusers of turbines produces certain amount of diffusion, and therefore also a pressure gradient, which adds to that which results from the increase of the diffuser cross-sectional area. In order to keep the magnitude of the pressure gradient the same as in the case of a flow having a uniform inlet velocity (no wakes) and maintain optimal amount of diffusion so as to avoid permanent flow separation from the diffuser walls, the rate of increase of diffuser cross-sectional area must be correspondingly smaller.

Changing steam turbine operating conditions, such as the changing of the condenser pressure which may be related to changes in turbine load or to changes in the cooling water temperature, causes the flow Mach number at the exhaust flow diffuser inlet to vary.

At condenser pressures higher that the condenser pressure used in the design of the turbine, when the flow Mach number at diffuser inlet is relatively low, as a result of creation of a large incidence angle of flow at the inlet of turbine blades, the flow separates from the turbine last blades resulting in creation of thick wakes at diffuser inlet. The process of decay of such wakes is responsible for generation of a significant amount of flow diffusion and pressure gradient, which adds to that produced by the increase of the diffuser cross-sectional area. In order to keep the magnitude of the pressure gradient in the diffuser at the same level as in the case of a flow with a uniform inlet velocity, that is, in a flow without wakes in it, having an optimal amount of diffusion, or an optimal pressure gradient, so as to avoid flow separation from diffuser walls, the rate of increase of diffuser cross-sectional area in a flow with wakes must be correspondingly smaller.

At condenser pressures approaching the design pressures, when the flow Mach numbers at diffuser inlet are high, being close to unity, the allowable rate of increase of the diffuser cross-sectional area is smaller than is the case when the condenser pressures are high and the flow Mach numbers are relatively low. (At such conditions, there is no flow separation from the last turbine blades, the wakes are relatively thinner and their effect on the amount of diffusion produced is correspondingly smaller than at high condenser pressure.) As a result, it is the flows at the relatively low diffuser inlet Mach numbers which place an upper limit on the rate of allowable diffuser cross-sectional area increase.

To account for the presence of wakes at diffuser inlet, a limit is placed on the initial rate of increase of diffuser cross-sectional area. In the diffuser of this invention, whether it is one of fixed shape or one whose cross-sectional area is variable by making use of an adjustable guide vane or vanes, which adjustable vanes surround at least a portion of the bearing cone, the initial increase of the cross-sectional area of the diffuser is limited to less than a predetermined fraction of the inlet area for a certain distance from the inlet.

In accordance therewith the area increase in the diffuser cross section from the inlet to a distance downstream from the inlet of one half the diffuser height at inlet, measured along the diffuser mean line for a diffuser of fixed shape or for preferably most of the travel path of an adjustable guide vane but at least for the adjustable guide vane position closest to the turbine last blades of a diffuser incorporating an adjustable guide vane or vanes is limited to no more than 5.0. This represents a value of a corresponding angle of a two-dimensional straight-wall diffuser of, approximately, 2.9 degrees. By limiting the increase in cross-sectional area of the diffuser to such percentage increase in the initial portion of the diffuser as defined, the wakes are allowed to substantially dissipate without producing flow separation from diffused walls after which the cross-sectional area of the diffuser may be increased at a higher rate consistent with a separation-free flow and corresponding mainly to the optimal rate determined for an incompressible and uniform flow corrected for the effect of compressibility. In addition, the length of the diffuser, measured along the mean line, should be greater than 90% of the length of the last blades of the turbine and preferably greater than the length of the last blade of the turbine within space limitations, and the radius of curvature of the outer flow guide should preferably be larger than one half of v the length of the blades of the last row of turbine blades.

BRIEF DESCRIPTION OF THE DRAWINGS

The nature of this invention will become clearer by reference to the following description, appended claims, and the views illustrated in the accompanying drawings in which:

FIG. 4*a* and FIG. 4*b* are graphs illustrating the parameters for a diffuser in accordance with this invention in which an adjustable guide vane, which partially surrounds at least a portion of the bearing cone, allows the cross-sectional area of the diffuser to be changed in response to changing turbine operating conditions. Curves denoted by letters "A" apply to the adjustable guide vane positions farthest away from the turbine last blades, curves denoted by letters "B" apply to the adjustable guide vane middle travel positions, and curves denoted by letters "C" apply to the adjustable guide vane positions closest to the turbine last blades. In FIG. 4*a* the diffuser cross-sectional area increase at a distance from inlet of one half of diffuser inlet height, measured along a mean line, is less than 5.0% for all adjustable guide vane positions. In FIG. 4*b* this condition is satisfied for adjustable guide vane positions B and C, but not for position A, that is for most of the travel path of the adjustable guide vane.

DETAILED DESCRIPTION OF THE INVENTION

Figure 1:
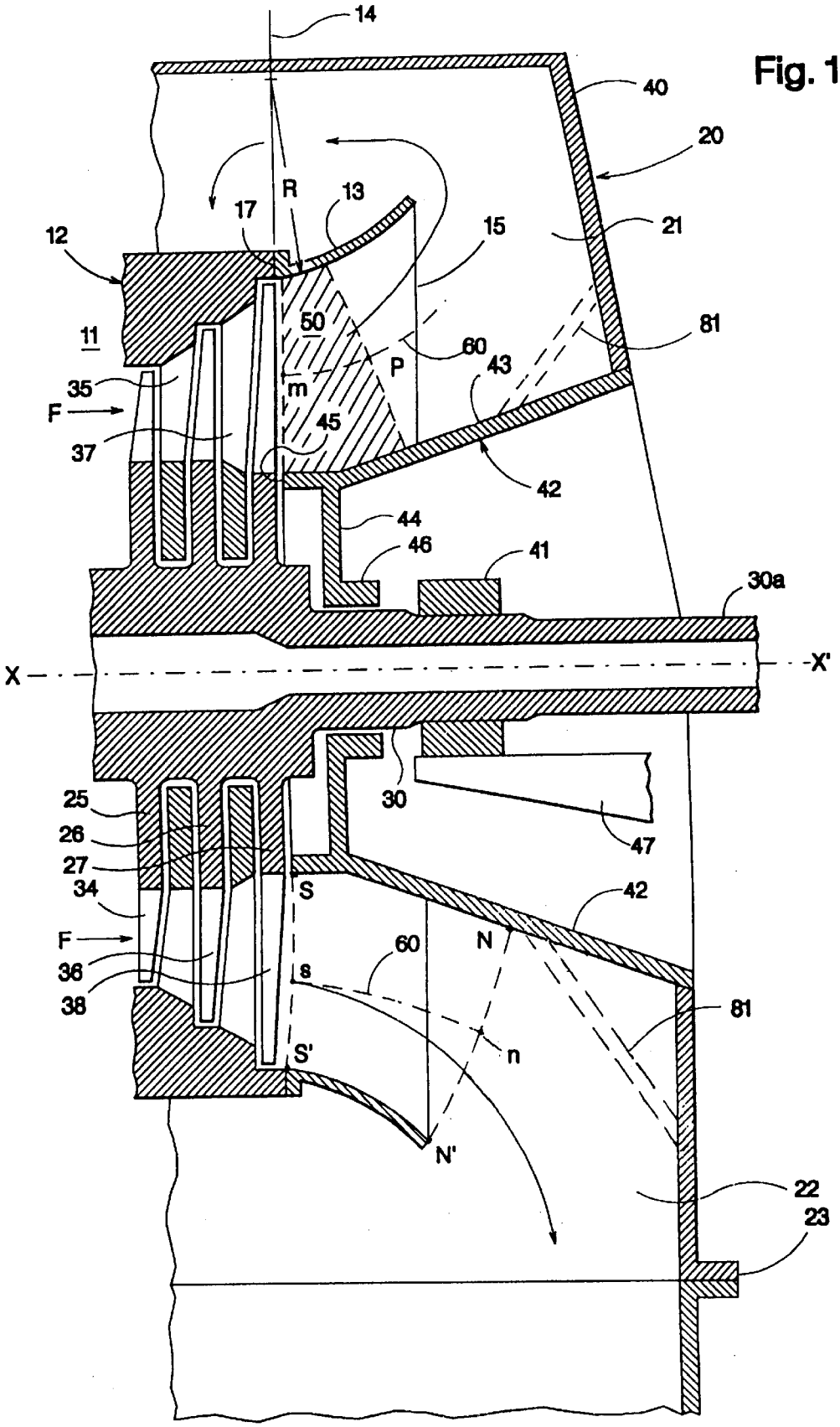
FIG. 1 is a schematic, longitudinal sectional view of the exhaust end portion of a multistage, low pressure, axial-flow condensing steam turbine incorporating the invention and showing the terminal portion of the turbine, the bearing cone, and the inlet portion of the downward-discharging exhaust hood. Also shown is the outer flow guide, and the exhaust flow diffuser defined by the outer flow guide and the outer surface of the bearing cone.

This invention, as explained above, relates to an annular diffuser, which may be defined as an annular flow passage whose cross-sectional area, for a subsonic flow, in general, increases with distance from the inlet and whose purpose is to produce diffusion in a flowing fluid in the nature of a gas or vapor, or more particularly of a fluid in the vapor state, i.e. to produce an increase of pressure and a decrease of flow velocity from the inlet to exit of such diffuser. Such increase of pressure along the length of a diffuser results, in an efficiently operating diffuser in a minimum pressure at the inlet to the diffuser. With the diffuser inlet located just downstream of the last row of blades of a steam turbine, the minimum pressure at the entrance to the diffuser produces a lowering of steam pressure at the last row of blades and thus increases the energy available for the turbine to do work and therefore also turbine efficiency.

The last row of blades of condensing steam turbines used in power generation are designed for a very low condenser pressure and for high, usually supersonic, relative flow velocity in the region near the tips of the blades. At condenser pressures higher than the design pressure the last blades of a turbine perform poorly as the steam flow tends to become separated from the blade surfaces as a result of a large flow incidence angle on the blades and turbine efficiency is as a result generally decreased. The purpose of a diffuser is, as noted above, to lower the steam pressure at the turbine exit and thus to increase the amount of energy available to the turbine and also to improve the performance of the last blades of the turbine even when condenser pressure is higher than the design pressure which occurs when the temperature of the condenser cooling water becomes higher than that assumed in design of the turbine. (Such situation usually occurs with a change of seasons in steam turbines using water cooled condensers and frequently occurs in units utilizing cooling towers.) This is especially important near the tips of the last blades of the turbine where the flow Mach number is highest and the amount of work done per unit blade length is highest; for example, see reference 9 cited in the prior art section. High subsonic (absolute) flow Mach number at the inlet of the diffuser normally requires a relatively smaller diffuser area ratio, or a small rate of increase of cross-sectional area, for a given amount of diffusion, (see Flow Tables for example in reference 10). Also, at condenser pressures higher than those used in design of the turbine, the fluid flow tends to separate from the last blades of the turbine, producing relatively deep wakes.

The higher the area ratio of a diffuser the greater the amount of diffusion produced in a well designed and well performing diffuser, which diffusion is advantageous, because it is diffusion, or deceleration of flowing steam, as a direct result of increasing cross-sectional area of the diffuser, which causes an increase in pressure as the steam progresses through the diffuser with a concomitant decrease in pressure at the last blades of the turbine, thereby making more energy available for utilization by the turbine blades. However, it has been determined that if the diffuser cross-sectional area increases too rapidly, the resulting flow in the diffuser will separate from the walls with a concomitant serious drop in performance of the diffuser. In order to prevent flow separation and loss of diffuser efficiency due to flow separation, the rate of cross-sectional area increase along the diffuser must be held below a certain predetermined value. In addition, as the diffuser inlet flow Mach number in the outer flow region tends toward unity when condenser pressure approaches turbine design back-pressure, in order to keep the pressure gradient in the diffuser below a certain level to avoid flow separation, the diffuser cross-sectional area increase must become very small. (This follows from equation 6–8 of reference 10.)

The large rates of increase of cross-sectional areas of the exhaust flow diffusers of the present-day steam turbines lead to a conclusion that they were designed assuming a uniform inlet flow, that is, without taking into account the presence of wakes at diffuser inlet and often even without accounting for the compressibility of steam. Considering that such diffusers are usually quite short, their exit-to-inlet area ratios are rather high, being in general higher than 1.27, their initial rate of increase of area with distance corresponding to one half of the diffuser inlet height being in general above 8.0%, with the corresponding two-dimensional straight-wall diffuser angle being above 4.6 degrees.

By area ratio at a particular location in a diffuser, it is meant the ratio of the diffuser cross-sectional area at that location to the diffuser cross-sectional area at the inlet. These areas are determined at the equi-potential lines, one drawn at the location in question and one at the diffuser inlet beginning at the bearing cone inner end, for the diffuser cross section in a corresponding radial plane passing through the turbine axis. The particular location in the diffuser at which the area ratio is being determined is to be defined at the diffuser mean line at the given cross section. By diffuser mean line, as the term is used herein, is meant the line connecting the mid points of the equi-potential lines drawn for the diffuser radial cross section being considered, extending from the inlet equi-potential line to the exit equi-potential line. By exit-to-inlet area ratio of a diffuser at a particular circumferential location, it is meant the ratio of the exit area to the inlet area determined in a radial plane passing through the turbine axis. The length of a diffuser, at a given circumferential location, corresponds herein to the length of the mean line at that location.

The equi-potential lines in a diffuser having a slowly increasing cross-sectional area with distance along the mean line have large radii of curvature, that is, they are relatively flat. As long as the equi-potential lines deviate little from straight lines, the exit-to-inlet area ratio of a diffuser at some circumferential location can be determined with reasonable accuracy by dividing the products of the lengths of the equi-potential lines and of the radii drawn perpendicularly from the turbine axis to the mid points of the equi-potential lines for the exit and inlet of the diffuser. A similar procedure can be used to determine area ratio for a location within the diffuser different than the exit.

The exhaust flow annular diffusers of the present invention should have their cross-sectional areas increase initially very slowly with distance along the diffuser mean line to allow wakes in the steam to dissipate significantly before the cross-sectional areas can begin to increase at a higher rate. This is because, if an increase of cross-sectional area corresponding to the optimal rate for a uniform flow, that is, for a flow without wakes is attempted when the wakes are still deep and thick, the overall diffusion and therefore also the pressure gradient will become too large and permanent flow separation or stall, will occur.

To decrease the chance of flow separation under the influence of a large pressure gradient and to promote a significant amount of diffusion in addition, the length of the diffuser, measured along the mean line, should preferably be larger than 90% of the length of the last blades of the turbine. Even more preferably, it should be larger than the last blade height, keeping in mind, of course, the space limitation inherent in a bottom discharging hood.

To avoid creation of a large pressure gradient and flow separation at the inlet to a diffuser, it is important that the diffuser at its beginning or entrance, that is in the vicinity of the last row of turbine blades, be defined or limited on its outer side by an outer flow guide having a large radius of curvature and a first or initial horizontal tangent. This radius of curvature of the outer flow guide should be, preferably, larger than one half (½) of the length of the blades of the last row of turbine blades.

Given below is a brief discussion of the most important relevant test results obtained on curved two-dimensional diffusers, followed by a review of the latest knowledge of flow in annular diffusers, with which this invention is concerned. All reported studies were made at high Reynolds numbers at which its effect is small, and most were made at low inlet Mach numbers, that is at incompressible flow conditions. Almost all studies were made with a uniform flow at diffuser inlets. This discussion is followed by an explanation of the reason for the choice of the limitation put on the corresponding two-dimensional straight-wall diffuser angle of this invention.

Test results on circular-arc center-line curved two-dimensional diffusers with uniform flow at inlet are presented in FIG. 8*a* of reference 2. They indicate that in such diffusers the location of the first appreciable stall line "is essentially unaffected by (diffuser) turning through angles less than or equal to 30 degrees" (conclusions on page 311). For that turning range, (0 to 30 degrees), the first appreciable stall occurs, for the diffuser dimension-less length defined as the ratio of diffuser length at centerline to diffuser height at inlet of 1.5, at the corresponding two-dimensional straight-wall diffuser angle (theta effective, $\theta_{EFF}$) of 10.5 degrees, the effective total divergence angle being 2 (theta effective, $\theta_{EFF}$) 21 degrees. At a diffuser turning angle of 40 degrees, for the same dimension-less diffuser length the first appreciable stall occurs much sooner, when the corresponding two-dimensional straight-wall diffuser angle reaches about 6 degrees, the effective total divergence angle being about 12 degrees. Diffuser turning angle in the range from 0 to 30 degrees is representative of the turning angle at inlet of annular diffusers located at condensing steam turbine exhausts.

The corresponding two-dimensional straight-wall diffuser angle $\theta_{EFFECTIVE}=\theta_{EFF}$ for a location in an annular diffuser some distance away from the inlet measured along the diffuser mean line is defined by equation:

$$\text{area ratio}(AR)_{\Delta x}=1+2(\Delta x/h_1)\tan\theta_{EFF}$$

where the area ratio $(AR)_{\Delta x}$ denotes the ratio of the diffuser cross-sectional area at the location at a distance "Δx" from the inlet being considered to the cross-sectional area at inlet. Symbol $h_1$ denotes the annular diffuser height at inlet and corresponds to the length of the equi-potential line at inlet;

in general, it is slightly larger than the height of the turbine final blades near diffuser inlet.

The earliest known report summarizing knowledge of flow in annular diffusers can be found in reference 3 by Henry et al. The experimental results given indicate that, for annular diffusers having exit-to-inlet area ratios of 1.75 and 1.91 and for the inlet flow Mach number of about 0.2, smallest losses occur at (total) expansion angles 20 between 12 and 22 degrees.

Test results for annular diffusers with uniform inlet flow given in reference 4 by Sovran et al. in FIG. 11 (page 286) were obtained on diffusers having inner and outer radius ratios at the inlet of 0.55 and 0.70 which are of interest in turbine design. (In steam turbine practice these ratios are, in general, close to 0.5.) They show plots of pressure recovery coefficients with diffuser exit-to-inlet area ratios obtained for three dimensionless diffuser lengths (defined as the ratios of wall length to diffuser annulus height at inlet) of 3.0, 5.0, and 7.0. The pressure recovery coefficient peaks move toward lower values of diffuser area ratios as the diffuser dimensionless length decreases. When locations of pressure recovery peaks are extrapolated to a dimensionless diffuser length of 1.0, which is of interest in most steam turbine applications, the optimal diffuser performance corresponds to diffuser area ratio of about 1.25, giving the optimal corresponding straight-wall diffuser angle $\theta_{EFF}$ of 7.12 degrees. This is in general agreement with the results given in reference 3.

FIG. 15 of reference 4 by Sovran et al. shows annular diffuser performance chart. By a small extrapolation it shows that in an annular diffuser with uniform inlet flow having length-to-inlet height ratio of 0.5 the optimal performance occurs at area ratio $A/A_1$=1.10 and that the corresponding optimal pressure recovery, or diffusion, coefficient is less than 0.2.

Reference 4 by Sovran et al., which reports an extensive study of flow in diffusers having uniform flow at the inlet, refers in a table in Appendix B to 23 annular diffusers located downstream of turbines (referred to as TD and TD,SW) with which this invention is concerned. Most of such diffusers were made up of two conical surfaces, one inside the other, and, their corresponding two-dimensional straight-wall angles $\theta_{EFF}$ were approximately constant along their lengths. The values of these angles were between 4.61 and 18.14 degrees, with most being in the range from 4.61 to 8.21 degrees. No information was provided with respect to the performance of these annular diffusers, most of which were designed for gas turbines.

Reference 5 by Howard et al. presents test results on performance and a study of flow regimes in annular equi-angular and straight core annular diffusers having a uniform flow at the inlet. The results for equi-angular diffuser shown in FIG. 4 of the reference indicate that, for the dimensionless diffuser length of 2.0 the first stall appears at twice the diffuser wall angle 20 of about 16 degrees, and the maximum pressure recovery should be expected at 20 of about 24 degrees. These results are not applicable to the exhaust flow diffuser of turbines because in the tests the diffusers were preceded by a long annular entry passage to give a fully-developed velocity profile at diffuser inlet.

Reference 6 by Deich et al. describes various studies on conical, annular, and axi-radial diffusers. It is devoted almost exclusively to performance studies in models of diffusers in which the flow at inlet is uniform. On page 410 the authors state that there is not enough data from tests on diffusers which are located downstream of the last blades of a turbine rotor wheel to allow reaching any final conclusions. Reference 7 presents in the report from the von Karman Institute, in FIG. 3.5.5, a comparison of the optimal geometry for two-dimensional, conical, and straight-core annular diffusers with uniform flow at inlet. For the annular diffuser, at a dimensionless length (length-to-inlet height) of 2.0 the optimal diffuser exit-to-inlet area ratio is about 1.4, for a dimensionless length of 1.0 the optimal area ratio is 1.2, and for a dimensionless length of 0.5, the optimal area ratio is given as about 1.1. For all these values the corresponding two-dimensional straight-wall angle $\theta_{EFF}$ is 5.71 degrees, the effective total divergence angle $2\theta_{EFF}$ being 11.4 degrees. [For a dimensionless length of 2.0, for the two-dimensional diffuser the optimal area ratio is given as 1.5 or the wall angle of 7.1 degrees, and for the conical diffuser as 1.6 or corresponding angle $\theta_{EFF}$=8.5 degrees.]

Reference 8 by Senoo et al. describes the only known study on the pressure recovery of (straight core) annular diffusers in a model in which tests were run with and without swirl in the inlet flow and with or without struts placed just upstream of the diffuser inlet. The swirl was introduced in the upstream plenum chamber. The reason why two or four struts were introduced was because, as stated in the Introduction, the diffuser hub is sometimes supported by struts. Although the investigators realized that the struts generated wakes in the inlet flow, the analysis of their test results concerns itself only with the effect of the shapes and placement of the struts, but not with the effect of wakes on the flow. The three conical wall straight core annular diffusers used in this study had half cone angles of outer walls of 4, 6 and 8 degrees. The corresponding straight-wall diffuser angles $\theta_{EFF}$ were 4.28, 6.40 and 8.49 degrees.

Figure 6:
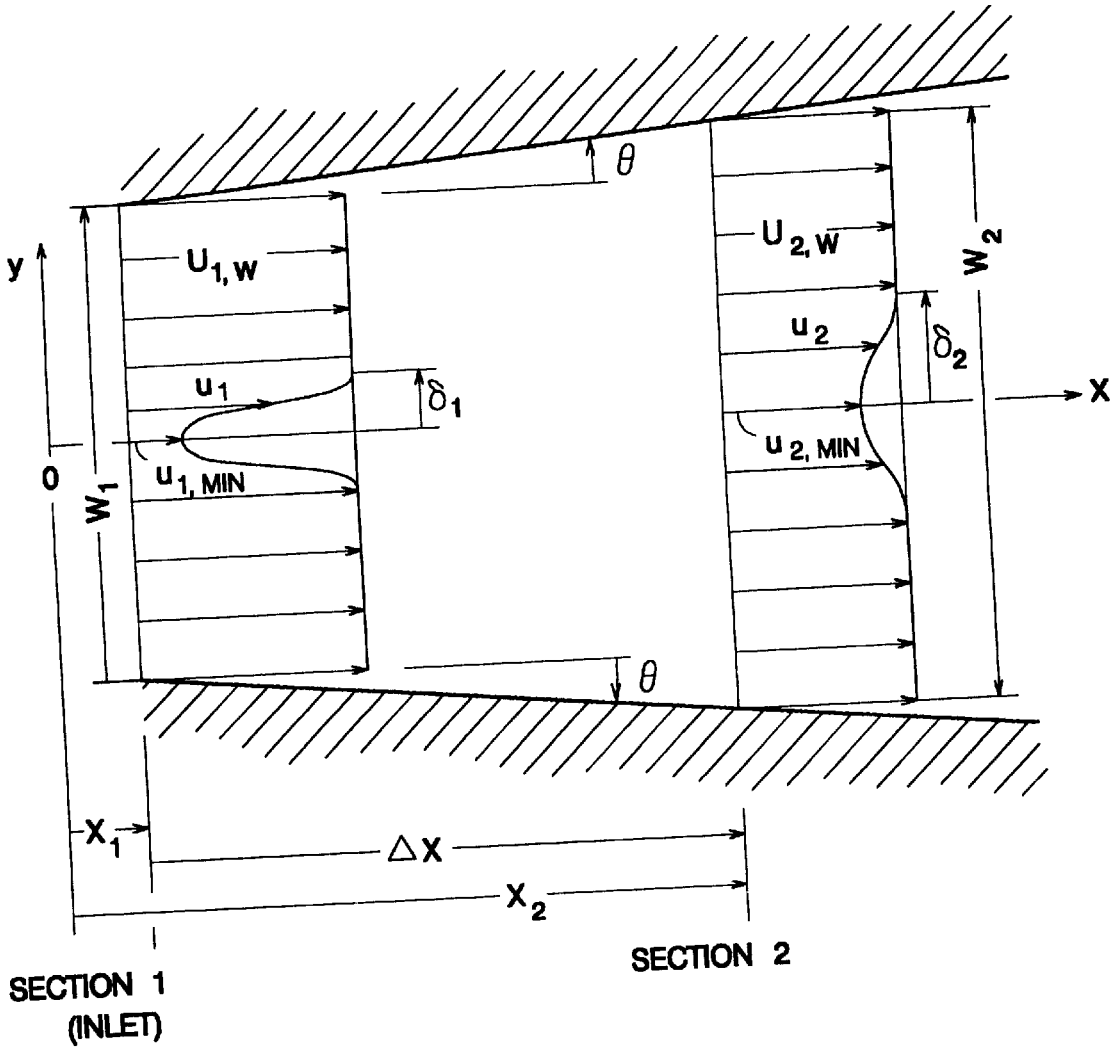
FIG. 6 shows a sketch of a two-dimensional straight-wall diffuser corresponding to that shown in FIG. 5 but with a wake in the flow.

The test data presented in FIG. 6 of reference 8 show that for the no swirl condition the performance (pressure recovery) of all three diffusers was in general better without struts, and therefore also without wakes, than with them. In addition, with or without struts present, diffuser performance kept improving with decreasing diffuser wall angle. It was best for the smallest corresponding straight-wall diffuser angle $\theta_{EFF}$ of 4.28 degrees. When a 26 degree swirl was introduced in the flow at zero stagger angle, at which conditions there must have existed flow separation and thick wakes downstream of the struts, the performance of all diffusers deteriorated badly compared to that of the diffuser tested without struts. (There occurred a pressure recovery coefficient drop of about 10%.) This indicates that even in the diffuser having wall angles as small as 4 degrees (the corresponding two-dimensional straight-wall diffuser angle was 4.28 degrees) the pressure gradient produced was too large and that even then the wakes adversely affected the diffuser performance. Once a stagger angle of struts had been introduced in the tests (gamma>0), the diffuser performance became affected by the pressure rise across the struts. No meaningful conclusions can be drawn from these results with respect to the diffuser shape required to minimize the effect of wakes on diffuser performance.

The test results of reference 8 have shown that wakes can have a detrimental effect on performance of annular diffusers even when the corresponding two-dimensional straight-wall diffuser angle is as low as 4.28 degrees. The value of the largest permissible value of the wall angle, or of the largest value of the corresponding two-dimensional straight-wall diffuser angle $\theta_{EFF}$ for the two or four thick wakes generated has not been determined because the noted tests series was a study of the effect of shapes and of placement of struts and not a study of annular diffuser shape on the effect of wakes on diffuser performance.

The present inventor has determined, (see Appendix), that in the case when a multitude of thick wakes enter a diffuser even when the inlet flow Mach number is not very high ($M_1$=0.5) the initial corresponding two-dimensional straight-wall diffuser wall angle $\theta_{EFF}$ must be very small, smaller certainly than 4.28 degrees, and that in such case the permissible corresponding two-dimensional straight-wall diffuser angles for annular diffusers with uniform inlet flow reported in the literature which are in the range of from 5.7 to 11 degrees, are too large. To be able to provide an optimal amount of diffusion in the presence of wakes, especially when such wakes are thick and deep which occurs at high back-pressures, in order to improve turbine efficiency, the cross-sectional area of a diffuser located in the exhaust hood at a steam turbine exit must initially increase very slowly with distance, to account for the pressure gradient produced by the decay of the wakes before a higher rate of increase of diffuser cross-sectional area can be utilized. While it might be preferable to maintain a constant initial diffuser cross-sectional area for a certain long distance in order to allow the wakes to dissipate, this may be both impractical in the usual limited room available in lower condenser installations and it also may result in moving the lowest pressure area of the diffuser away from the last blades of the turbine where it is desired for maximum power.

There is a balance established between the desirability of obtaining a maximum diffusion to decrease pressure at the beginning of the diffuser which tends to be maximized by greater diffuser area ratios and the decrease in diffuser efficiency brought about by flow separation caused by the additional pressure gradient produced as a result of decay of wakes in the diffuser. These competing considerations have not been clearly recognized by previous workers.

It is the intent of this invention, therefore, to provide an upper limit to the allowable corresponding two-dimensional straight-wall diffuser angle for an annular diffuser in the region near to the inlet when the incoming flow has in it thick wakes coming from the turbine last blades. At a distance of one half of diffuser height at the inlet measured along the diffuser mean line from its inlet the corresponding two-dimensional straight-wall diffuser angle should be no more than 2.9 degrees for most of its circumference, which corresponds to the rate of area increase of 5.0%. This limit is placed on diffusers whose shape (cross-sectional area) does not change, as is the case with almost all steam turbines operating today, and also on turbines equipped with adjustable guide vanes which surround at least a portion of the bearing cone and whose cross-sectional areas can be changed in response to changing turbine operating conditions for preferably most of the adjustable guide vane travel path and at least for the adjustable guide vane position closest to the turbine last blades. Such adjustable guide vanes are disclosed in U.S. Pat. No. 5,209,634 entitled "Adjustable Guide Vane Assembly for the Exhaust Flow Passage of a Steam Turbine" issued May 11, 1993, to the present inventor.

The annular diffusers to which the teachings of this invention are applied are generally defined by or comprised of the outer flow guide and either the outer surface of the bearing cone in case of steam turbines having diffusers of fixed shape, or, for the most part, by the inner adjustable guide vane or vanes in case of turbines fitted with such devices.

The present inventor, therefore, has determined that, contrary to the prevailing practice and understanding as evidenced by the available literature references, in order to compensate for wakes in exhaust from low pressure condensing steam turbines in which, as is usually the case, the condenser pressure varies the increase of the cross-sectional area in the diffuser at a distance of one half of the diffuser height at inlet should be no greater than 5.0% of the cross-sectional area of the diffuser at its inlet which corresponds to a two dimensional straight wall diffuser angle of 2.9% degrees. Thereafter i.e. after a distance of one half of the diffuser height at inlet or approximately one half of the length of the last blades of the turbine, the corresponding two dimensional, straight-wall diffuser angle can be acceptably higher or greater over the remaining length of the diffuser, the total length of which should preferably be at least 90% of the length of the last turbine blades and preferably at least equal to the length or height of the last turbine blades.

In FIG. 1 there is shown a partial longitudinal cross section of a portion of the exhaust end of a multistage, axial-flow, condensing steam turbine indicated generally as 11. Turbine 11 has casing 12 partly shown and outer flow guide 13 having radius of curvature R at its beginning, shown partially displaced from perpendicular 14, plus outer end 15 and inner end 17. A tangent, not shown, to the radius of curvature R of the flow guide drawn at the beginning of the outer flow guide at perpendicular 14 would be horizontal or at a right angle to the perpendicular 14. The radius R of the flow guide is equal to at least one half of the length of the last blade 38 of the turbine and preferably greater than one half of such length. Surrounding at least part of the casing 12 is an exhaust hood 20 having top portion 21 and bottom portion 22, which bottom portion connects by flange 23 to a condenser, not shown, but understood to be directly below. Only partial sections of the top and bottom portions 21 and 22 of the exhaust hood 20 are shown and it will be understood the exhaust hood proper extends circumferentially about turbine casing 12. Exhaust hood 20 has end wall 40.

Extending through turbine casing 12 and the exhaust hood 20 is turbine shaft 30 having central longitudinal axis X–X' and outer portion 30*a* mounted in bearing 41 resting on bearing pedestal 47. Attached to turbine shaft 30, at spaced intervals, are turbine disks 25, 26, and 27 and fastened to each such disk is turbine blade row 34, 36 and 38 respectively. These reference numerals are shown on the lower half of the section of the turbine shown. In front of the turbine blade rows 36 and 38 are nozzle rows or stationary blades 35 and 37, respectively, designated on the upper half of the turbine.

As will be further understood in FIG. 1, flow guide 13 extends from casing 12 of the turbine to which it is fastened, for 360 degrees circumferentially about shaft 30 and longitudinal axis X–X' within exhaust hood 20.

Extending from the vicinity of the adjacent turbine disk 27 is bearing cone 42 which has the shape of a truncated cone and which surrounds turbine shaft outer portion 30*a* and bearing 41. Bearing cone 42 has an outside surface 43 facing outer flow guide 13 and an inside surface not specifically designated facing bearing 41 and shaft 30. Extending from bearing cone 42 is bearing cone inner plate 44 adjacent inner end 45 of the bearing cone. Mounted centrally of bearing cone inner end plate 44 is shaft seal 46 the purpose of which is to prevent flow of air into the exhaust hood 20 along turbine shaft 30. Also indicated, by broken lines, since usually it is not present, is corner insert 81 which may be placed over the corner between the bearing cone 42 and the exhaust hood end wall 40, which corner insert extends all the way around the bearing cone and has the shape of a truncated cone.

Steam flows in the turbine from left to right as indicated by arrows F in FIG. 1, through turbine casing 12, turbine blade rows 34, 36 and 38 to the exhaust hood and then downward to the condenser, which, as noted above, is not shown. Immediately following turbine blade row 38 is diffuser 50, which is defined by the outer flow guide 13 and bearing cone outer surface 43, such diffuser having a mean line 60. The first equi-potential line S–S' at the inlet of the diffuser cross section illustrated, and the last equi-potential line N–N' at the exit are indicated in the bottom portion of the cross section shown in FIG. 1. Also indicated in the bottom portion of the cross section are the mid points "s" and "n" on the first and last equi-potential lines representing the beginning and the end of the mean line shown and the length of the diffuser there.

The inner surface of the outer flow guide 13 and the outer surface 43 of the bearing cone 42 facing the outer flow guide 13 and serving as the inner flow guide are arranged in accordance with the invention to form a diffuser having an initial portion shown shaded in the top portion of the cross-section shown in FIG. 1. The mean line of such diffuser portion extends for one half of the height of the diffuser inlet, from point "m" (which corresponds to point "s" in the bottom portion of the cross section) to point "p" and the cross-sectional area of such diffuser portion increases by no more than 5.0% of the cross-sectional area of the diffuser at the inlet, or has a corresponding two-dimensional straight-wall diffuser angle of no more than 2.9 degrees. In addition, it will be seen that the length of the entire diffuser 50, taken along the mean line 60, is somewhat longer than the length of the last blade 38 of the turbine and thus at least 90% of such length and the radius of curvature R of the outer flow guide is approximately equal to the length of the last turbine blade and therefore significantly larger than one half the length of the last turbine blade.

Figure 2:
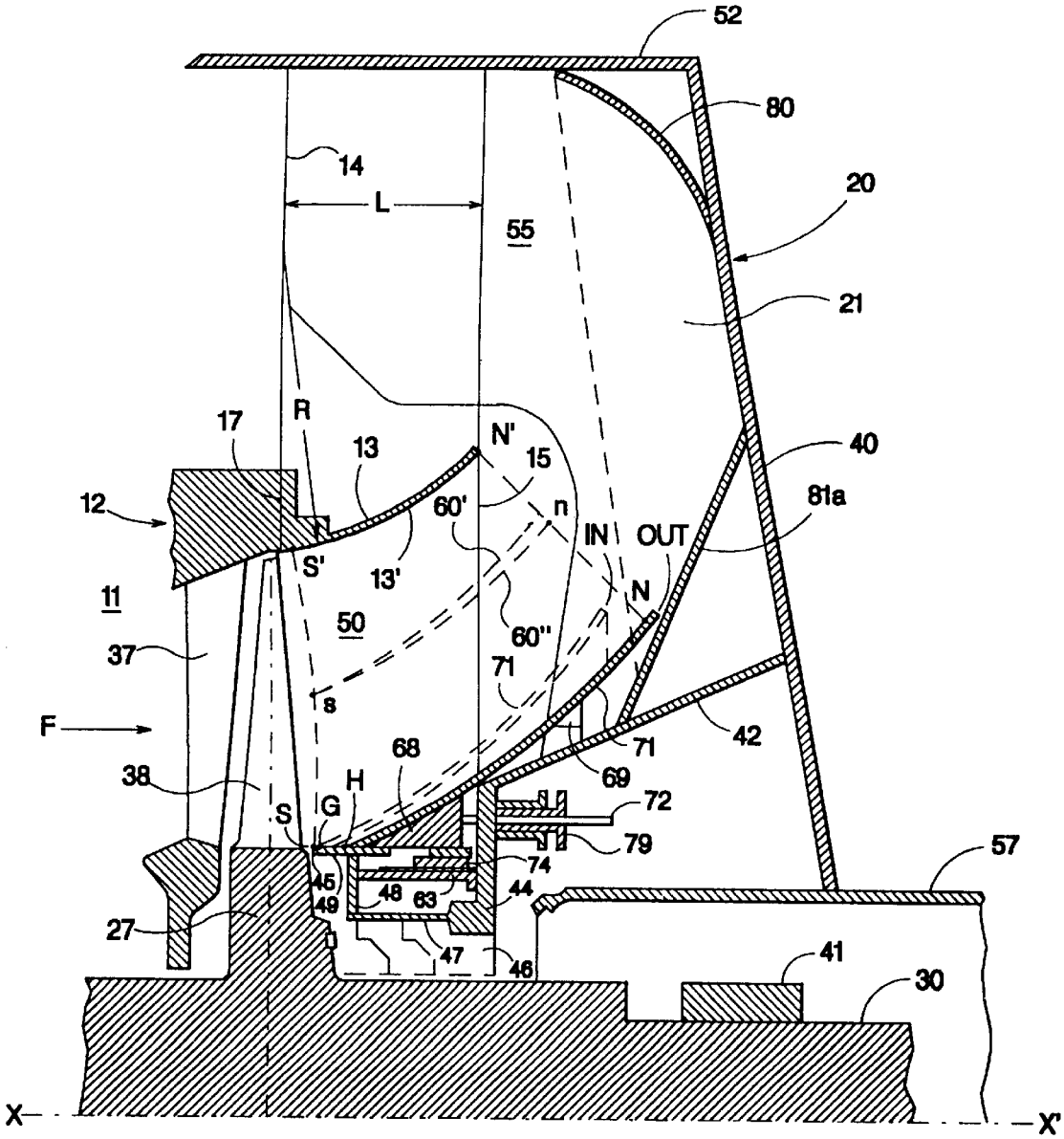
FIG. 2 is a schematic, longitudinal sectional view of the upper part of the exhaust end portion of a multistage, low pressure, axial-flow condensing steam turbine incorporating the invention and showing the terminal portion of the turbine, the bearing cone, and an adjustable guide vane system or arrangement. The exhaust flow diffuser, defined for the most part by the outer flow guide and the movable adjustable inner guide vane, has a cross-sectional area which can be varied.

In FIG. 2 there is shown a partial longitudinal cross section of the top portion of the exhaust end of a multistage axial-flow, condensing steam turbine. The general turbine, diffuser and exhaust hood structure shown in FIG. 2 is similar to that shown in FIG. 1 and the same structures have, for convenience, been assigned the same reference numerals. In FIG. 2, however, the condensing steam turbine 11 has an adjustable flow guide vane 71 mounted around, and supported by, bearing cone 42. Such adjustable flow guide allows for the cross-sectional areas of the diffuser 50 to be broadly altered during operation to select the best configuration for maximum energy extraction from the steam under various conditions and in FIG. 2 has been shown in more detail than generally disclosed in the present inventor's U.S. Pat. No. 5,209,634 issued May 11, 1993, and entitled "Adjustable Guide Vane Assembly for the Exhaust Flow Passage of a Steam Turbine." Similar structures shown in both FIG. 1 and FIG. 2 are, as noted above, identified by the same reference numerals.

Turbine 11 in FIG. 2 has casing 12 and outer flow guide 13 having radius of curvature R at its beginning, shown partially displaced from perpendicular 14, plus outer end 15 and inner end 17. A tangent, not shown, to the outer flow guide at the beginning of such outer flow guide at perpendicular 14 would be horizontal or at a right angle to the perpendicular 14. The radius R of the flow guide 13 is equal to at least one half of the length of the last blade 38 of the turbine.

Surrounding the casing 12 is the exhaust hood 20 having top portion 21 and a bottom portion, not shown, outer wall 52 and end wall 40. End wall 40 is slanted toward turbine 11 in the top portion of exhaust hood 20. It will be understood that the exhaust hood proper extends circumferentially about turbine casing 12. Inside the exhaust hood 20 are corner inserts 80 located at the corner between the outer wall 52 and end wall 40, and corner insert 81*a* located at the corner between the bearing cone 42 and the end wall 40. Insert 81*a* is similar to the corner insert 81 shown in FIG. 1. The purpose of the corner inserts is to guide the exhaust steam flow so as to avoid or at least minimize flow separation in the corners. Corner insert 80, which can be curved as shown or be flat, extends through the whole top portion of the exhaust hood and into the bottom portion. Corner insert 81*a* extends all the way around the bearing cone and has preferably the shape of a truncated cone. Supporting the exhaust hood top portion 52 from inside is vertical rib 55 extending to the bearing cone 42.

Extending through turbine casing 12 and the exhaust hood 20 is turbine shaft 30 having central longitudinal axis X–X' and supported by bearing 41. Also shown is bearing cover 57. Attached to turbine shaft 30, is turbine disk 27 and fastened to turbine disk 27 is turbine last blade row 38. In front of blade row 38 is a row of stationary nozzles or blades, 37.

Outer flow guide 13 extends from casing 12 of the turbine to which it is fastened, for 360 degrees circumferentially about shaft longitudinal axis X–X' into exhaust hood 20. It comprises top guide portion 13' located in the top portion of the exhaust hood 21 and bottom portion, not shown, located in the bottom portion of the exhaust hood 20. Both, the top and bottom portions of the outer flow guide 13 extend 180 degrees about turbine axis X–X' forming together a full 360 degrees of flow guide surrounding the turbine shaft. Such outer flow guides often have shapes which are not uniform around axis X–X', e.g. the length or configuration of the outer flow guide may vary from point to point such as by having the top portion above the turbine shaft shorter than other portions. In each case, however, the guide will conform overall with the parameters of the present invention. Flow guide 13 illustrated in FIG. 1 has its top portion 13' having a constant axial length L in its top portion.

Extending from adjacent the outer extent of turbine disk 27, which supports turbine blade 38, is bearing cone 42 which surrounds turbine shaft 30 and bearing 41 as well as in the case shown, a portion of the bearing cover 57. Extending from bearing cone 42 is bearing cone inner plate 44, which supports shaft seal 46 as in FIG. 1. The arrangement of the bearing cone inner plates has been varied somewhat from that usually found in order to operably support the adjustable guide vane 71. Extending laterally from the end of bearing cone inner plate 44 is bearing cone inner plate extension 47 which supports at its end bearing cone inner plate 48 which supports in turn the inner section 49 of the bearing cone adjacent the turbine blades 38 the end 45 of such section being directly adjacent the turbine as in FIG. 1. A further bearing cone inner plate 63 extends from the bearing cone inner plate 48 and abuts bearing cone inner plate 44. The shaft seal 46 prevents flow of air into exhaust hood 20 along turbine shaft 30. Shaft seal 46 is also partially supported by bearing cone inner plate extension 47.

Surrounding, at least partially, bearing cone 42 is the adjustable guide vane 71 shown in two positions, namely its extreme "in" and extreme "out" positions. The "out" position is shown in solid lines and the "in" position is shown in dashed lines. At its inner portion, adjustable guide vane 71 is supported, at its end adjacent last turbine blade row 38, by one or more plane linear bearings 74 which are slidably supported upon the bearing cone inner plate 63. The lower portion of adjustable guide vane 71, not shown, is supported by cylindrical linear bearings attached to the bearing cone. Adjustable guide vane 71 has reinforcing rings 68 and 69 to which are attached shafts, not shown, which shafts enter the cylindrical bearings. Axial motion of adjustable guide vane 71 is made possible by one or more suitable actuators, not shown, utilizing actuator rod 72 attached to reinforcing ring 68. Actuator rod 72 is located in the vertical plane and is connected to one or more actuators located outside the exhaust hood. At the location where actuator rod 72 penetrates bearing cone inner plate 44 there is provided packing 79 whose purpose is to minimize leakage of air into exhaust hood 20 at such point.

Steam flows in the turbine from left to right as indicated by arrow F through turbine casing 12, turbine blade row 38 to the exhaust hood and then downward to a condenser, not shown, below the hood in the general manner shown in FIG. 1.

Immediately following turbine blade row 38 is diffuser 50, which is defined by the outer flow guide 13 and for most of its path by the adjustable guide vane 71. Diffuser 50 has mean line 60' when the adjustable guide vane 71 is in the "in" position, that is, when it is closest to last blade row 38, and mean line 60" when it is in the "out" position, that is, when it is at its largest distance from last row of blades 38. The first equi-potential line S–S' at the inlet of the diffuser cross-section illustrated which extends from the bearing cone inner end 45 to the outer flow guide 13, and the last equi-potential line N–N' at the exit, are shown. Also shown are the mid points "s" and "n" on the first and last equi-potential lines, respectively, representing the beginning and the end of the mean line 60" shown and the length of the diffuser for the "out" position of the adjustable guide vane 71. The equi-potential line N–N' at the diffuser exit changes depending upon the position of the adjustable guide vane 71 or more particularly the movement of the end of the adjustable guide vane 71. Horizontal line G-H drawn along the inner plate 49 of bearing cone 42 represents broadly the travel path of the adjustable guide vane 71. Point G represents the tip of the adjustable guide vane 71 when it is in position closest to turbine last blades 38, and point H represents the tip when the adjustable guide vane is farthest away from turbine last blades 38.

Figure 3:
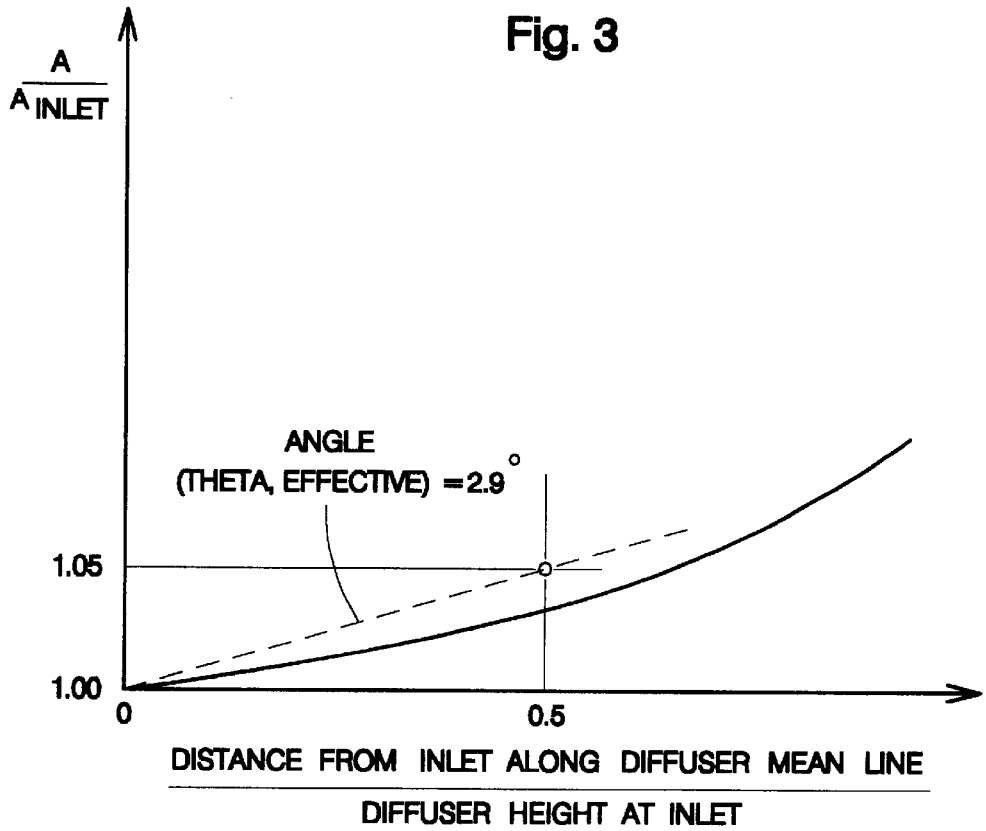
FIG. 3 is a graph showing, for a diffuser of this invention having a fixed, unchanging, shape, a typical variation of the ratio of diffuser cross-sectional area to the inlet cross-sectional area with a dimensionless distance from diffuser inlet measured along the diffuser mean line.

FIG. 3 is a graph showing, for the diffuser of this invention having a fixed shape, a typical variation of diffuser area ratio with dimensionless distance from inlet along a mean line. The abscissa designates a dimensionless distance from the inlet of the diffuser along the mean line of the diffuser and the ordinate represents the area ratio of the diffuser at any point along the abscissa. A(inlet) refers to the diffuser cross-sectional area at inlet, determined at the first equi-potential line for the diffuser. Diffuser height at inlet is defined herein as the length of the first equi-potential line at inlet drawn from the bearing cone inner end as indicated in FIG. 1 and FIG. 2. At a dimensionless distance from inlet measured along a mean line of 0.5 the diffuser cross-sectional area increase from inlet is less than 5.0 [The ratio A/A (inlet) being less than 1.05.] and the corresponding two-dimensional straight-wall diffuser angle is smaller than 2.9 degrees. At distances larger than one half of diffuser height at inlet diffuser cross-sectional area can increase at rates which are acceptably higher than at smaller distances.

Figure 4A:
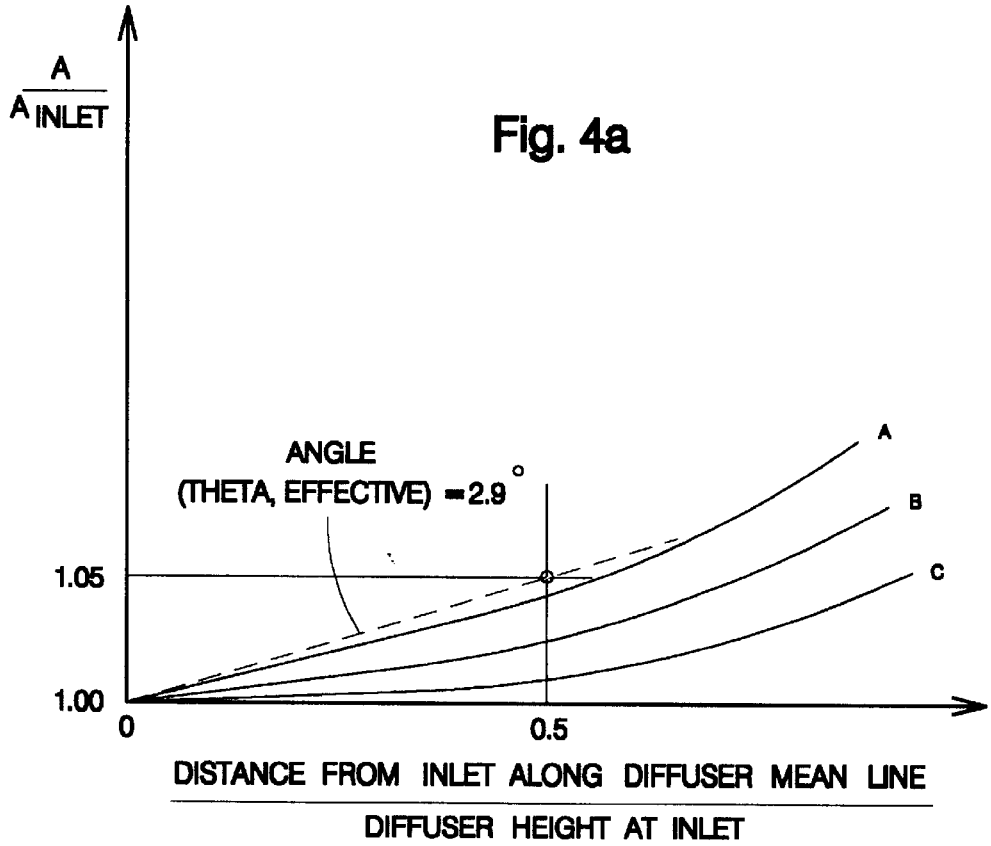

FIGS. 4*a* and 4*b* show graphs similar to that shown in FIG. 3 for the diffuser of this invention whose cross-sectional area variation with distance can change through utilization of an adjustable guide vane whose position along turbine axis can be changed in response to changes in turbine operating conditions. Curves denoted by the letters "A" apply to the adjustable guide vane position farthest away from the turbine last blades, curves denoted by the letters "B" apply to the adjustable guide vane in its middle position, and curves denoted by the letters "C" apply to the adjustable guide vane in position closest to the turbine last blades. Curves "A" should be applicable to the turbine operating conditions at which the condenser pressure is much higher than that assumed in turbine design. In such case large flow separations from turbine last blades and thick and deep incoming wakes are to be expected. Curves "C" should be applicable mainly when the condenser pressures are close to the low value used in turbine design at which there should be no flow separation from the blades, and as a consequence the wakes should be relatively thin, but at which the flow Mach number in the region of the tips of the turbine last blades is close to unity, and therefore at which a small increase of diffuser cross-sectional area results in a large increase of the pressure gradient in the diffuser, which must be limited in order to avoid flow separation and stall. Curves "B" should correspond to intermediate turbine operating conditions.

In FIG. 4*a* in particular the diffuser cross-sectional area increases at a distance from inlet of one half of diffuser inlet height, measured along a mean line, are less than 5.0% for all adjustable guide vane positions. In FIG. 4*b* on the other hand this condition is satisfied for the adjustable guide vane positions B and C but not for position A.

Figure 5:
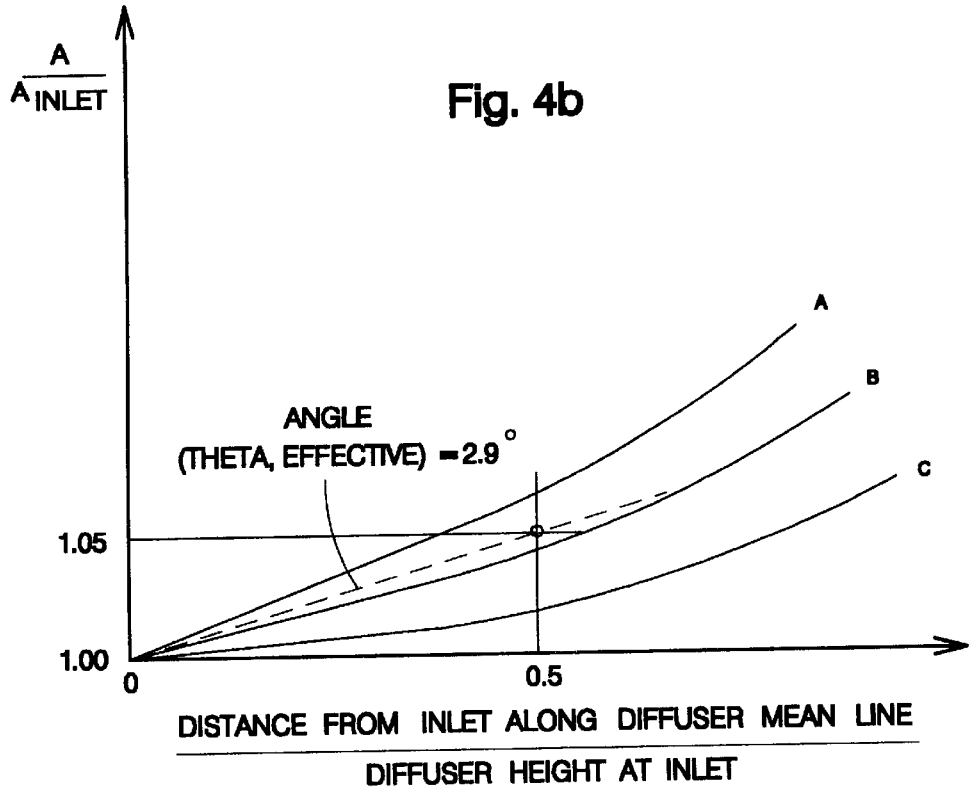
FIG. 5 shows a sketch of a two-dimensional straight-wall diffuser with uniform flow.
Figure 5:
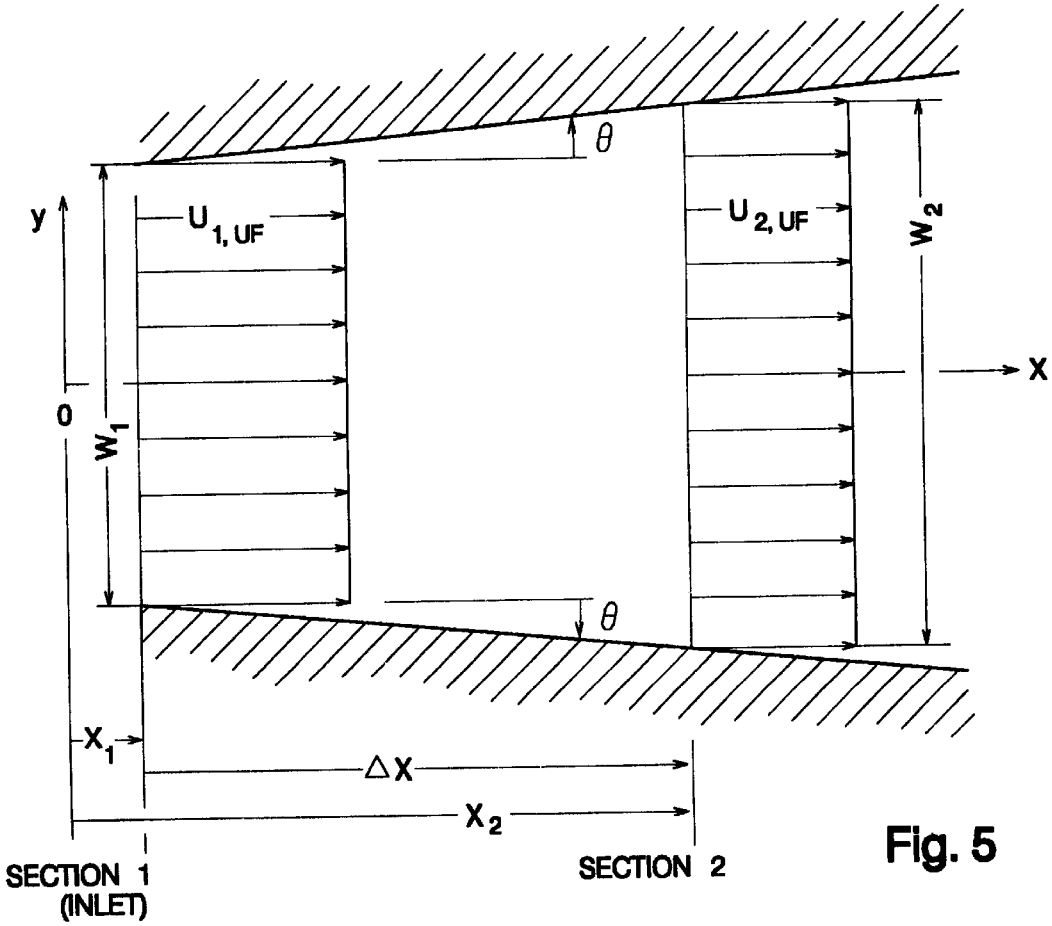

FIG. 5 is a sketch of a two-dimensional, straight-wall diffuser with a uniform flow. The velocities at section 1 at inlet and at section 2 a distance of $\Delta x$ from inlet are shown.

FIG. 6 is a sketch of a two-dimensional straight-wall diffuser of FIG. 5, but with wakes in it. Velocity distribution at inlet, section 1, and at section 2 a distance $\Delta x$ from inlet are shown.

There is appended hereinafter at the conclusion of the description herewith an Appendix providing the details of the inventor's physical and mathematical modeling and of the theoretical analysis on which the present invention is based.

The results of such modeling clearly show the fact not previously generally recognized that the wakes unavoidably present in a diffuser used immediately after a gas or vapor turbine such as a steam turbine have an effect on the diffusion process in a diffuser similar to that of the diffuser cross-sectional area increase. This is so because the decay of wakes caused by the viscosity of the fluid reduces the velocity of the main, or free, stream outside of it and produces an increase of pressure in the diffuser. This pressure increase is additive to the pressure increase caused by increasing cross-sectional area of the diffuser. Too rapid an increase in pressure in a diffuser beyond a fairly well defined limit will cause fluid flow separation from the walls of the diffuser. The effect of wakes in such fluid flow should be allowed for in limiting the expansion along the diffuser in order to allow efficient operation of the diffuser. Because of this additive relationship between the pressure increase caused by the decay of wakes and by the increase of diffuser's cross-sectional area, the present applicant has found that the rate of increase in cross-sectional area of the diffuser should, in order to avoid flow separation from the walls of the diffuser, be limited in the first portion of the diffuser to provide an opportunity for the wakes to decay or dissipate with an increase of fluid pressure before normal expansion in the diffuser is allowed. Applicant's calculation and accompanying claims provide the necessary limitations that must be adhered to allow for or compensate for the presence of wakes in the exhaust steam entering the diffuser, namely the expansion of the diffuser should be limited in the initial portion extending to approximately the length of half the length of the last blades of the turbine by limiting the increase in cross-sectional area to not greater than 5% of the diffuser inlet cross-sectional area or the equivalent of a two-dimensional straight-wall diffuser angle of 2.9 degrees.

The following simple physical explanation may aid in understanding why the presence of wake in the fluid passing through a diffuser produces an effect similar to that caused by the increase of the diffuser cross-sectional area. The wakes initially represent space in the diffuser with very small flow rate through it around which space the faster flowing fluid outside the wakes passes. As a result of viscous interaction between the fluid in the wakes and the surrounding higher velocity fluid, entrainment of the surrounding fluid into the wakes takes place, with the resulting flow velocity increase in the wakes. (The wakes spread as a result of viscous interaction with the outside fluid, while their depth decreases.) Thus in effect the decaying wakes in a diffuser provide additional area available for the outside fluid to fill.

As explained above therefore and particularly with respect to FIG. 1, the present inventor has determined by mathematical modeling as set forth in the accompanying Appendix that in order to account for or accommodate to the effects of the decay of the wakes and of compressibility of steam the cross-sectional area increase in the initial portion of the diffuser extending to a distance of preferably one half of the height of the diffuser at the inlet should be restricted to no more than 5.0% of the cross-sectional area at inlet or that the corresponding two-dimensional, straight-walled diffuser angle be restricted to approximately 2.9 degrees. The length of the diffuser should be preferably at least 90% of the length of the length of the last blades of the turbine and more preferably at least the length of the last blades. It will be recognized in this regard that with respect to the variable guide vane arrangement shown in FIG. 2 that these parameters are adhered to in FIG. 2 for preferably most of the travel path of the adjustable guide vane 71.

The exhaust flow diffuser of this invention has been described in preferred manner, without considering diffusers in which the outer flow guides which define their outer boundaries, may have shapes which are non-uniform around the circumference of the turbine. Also, no consideration was given to turbine exhaust flow diffusers in which corner inserts placed between the bearing cones and the exhaust hood end walls, or the exhaust hood end walls themselves, may form portions of the diffusers, or to diffusers which may have splitter vanes placed within them, or turning vanes placed at their exits. Although the shapes of such diffusers may differ from the simple, circumferentially uniform, shape described, and their cross-sectional areas may vary around the circumference of the turbine, such diffusers are subject to the same restriction on their initial rate of increase of cross-sectional areas as the diffusers described herein. It is recognized that modifications and variations can be made by those skilled in the art to the above described invention without departing from the spirit and scope thereof as defined by the appended claims.

While the present invention, therefore, has been described at some length and with some particularity with respect to two particular embodiments, it is not intended that it should be limited to any such particulars or any such particular embodiments, but is to be construed with reference to the appended claims so as to provide the broadest possible interpretation of such claims in view of the prior art, therefore, to effectively encompass the intended scope of the invention.

Appendix

Analysis Leading to the Design Criterion which Restricts the Initial Rate of Increase of Diffuser Cross-Sectional Area so as to Prevent Separation of Flow in Exhaust Flow Diffusers of Condensing Steam Turbines Introduction The object of this analysis is to obtain a design criterion which sets a limit on the rate of increase of the cross-sectional area of the initial portion of an exhaust flow diffuser of a condensing steam turbine so that diffusion of flow can take place at or near optimal performance and flow separation from diffuser walls can be avoided for given operating conditions characterized by the inlet flow Mach number to the diffuser. The limit placed on this rate of increase of diffuser cross-sectional area is more restrictive than the generally used limiting rate of increase corresponding to a uniform incompressible flow at inlet. It takes into account the effect of wakes present at diffuser inlet and of compressibility of steam. The restriction on the rate of increase of the diffuser cross-sectional area will be limited to a distance from diffuser inlet, $\Delta x$, of one half of the diffuser height at inlet, $h_1$, because it is the region near the inlet to a diffuser that is affected most by the wakes and by the compressibility of the flowing fluid.

A diffuser for a subsonic flow is a duct whose cross-sectional area increases with distance and whose purpose is to diffuse, or to slow down, the flowing fluid so that a large fraction of its kinetic energy is converted into enthalpy with the accompanying increase of fluid pressure. The purpose of an exhaust flow diffuser of a steam turbine is to produce lowering of pressure downstream of the turbine last blades for a given condenser inlet pressure which results in an increase of the energy available to the turbine to do work and, therefore, in an increase of the efficiency of the whole unit.

The main feature characteristic of flows in the exhaust flow diffusers of turbo-machinery which makes these flows so much different from the vast majority of diffuser flows is the presence of wakes at diffuser inlets. The wakes which affect the exhaust flow diffuser performance most form from boundary layers at the trailing edges of the turbine last blades. They can become quite thick when separation of flow from the last blades takes place. Other wakes may also enter an exhaust flow diffuser, for example those from the wires which tie together the last blades, as well as the traces of wakes left over from the wakes produced by stationary nozzles located upstream of the last blades. All these wakes enter the exhaust flow diffusers where they decay. The process of decay of wakes results in a decrease of the velocity of the free stream outside the wakes as a result of which diffusion and pressure rise occurs in the diffuser. In the analysis which follows we will consider only the wakes coming from the last blades and neglect any other wakes. Thus the analysis will be conservative and will underestimate somewhat the effect of wakes on diffuser performance.

The rate of increase of the cross-sectional area of a diffuser, and the rate of decrease of the flow velocity and the rate of increase of pressure which results from it, are limited by the allowable pressure gradient within the diffuser. If the pressure gradient is too large then the boundary layer flow will separate from diffuser walls and little if any diffusion will take place.

Test on diffusers having uniform flow at inlets, performed mostly at low flow speeds which are referred to as incompressible flows, have provided information on the rates of increase of the cross-sectional areas which two-dimensional straight-wall diffusers, conical diffusers, annular diffusers, and curved diffusers of given lengths should have in order to achieve optimal performance, that is to achieve the highest amount of diffusion, or pressure rise and to avoid large flow separation.

The performance of annular exhaust flow diffusers of turbines in which the operating conditions may depart significantly from the turbine design conditions, which departure results in significant flow separations from last blades producing thick wakes at the inlet to the diffusers, is affected very significantly by the presence of the wakes. This is so because the pressure gradient in the flow is created not only by the increase of the diffuser cross-sectional area but also by the flow diffusion caused by the decay process of the wakes. In order to avoid separation of flow from diffuser walls, and therefore to keep the pressure gradient in the diffuser below a certain magnitude, the rate of increase of the diffuser cross-sectional area has to be decreased relative to that corresponding to uniform inlet flow in order to compensate for the diffusion, and therefore also pressure gradient, produced by the decay of wakes. In addition, an analysis whose goal is to determine the optimal geometry of a diffuser, must take into account also the effect of compressibility of the fluid on the relationship between the rate of increase of diffuser cross-sectional area and the resulting pressure rise.

The analysis which follows, whose object is to obtain an estimate of the effect of decay of wakes on the optimal rate of increase of the cross-sectional area of an annular diffuser, is made for a two-dimensional straight-wall diffuser with an incompressible flow having a wall angle equal to the corresponding optimal angle of an annular diffuser.

Subsequently, compressibility of the flowing fluid is accounted for.

FIG. 5 shows a drawing of a two-dimensional straight-wall diffuser of unit height with a uniform flow and explains the meaning of terms used in the analysis. The presence of boundary layers at the walls will be disregarded when modeling the velocity profiles because they are practically the same in a flow with and without wakes in it.

The equation for a two-dimensional small wall angle straight-wall diffuser relating the ratio of cross-sectional area A at a distance $\Delta x$ away from the inlet and the inlet cross-sectional area $A_1$, or the diffuser widths W and $W_1$, to the diffuser angle $\theta$ can be written as $$\frac{A}{A_1} = \frac{W}{W_1} = 1 + 2\left(\frac{\Delta x}{W_1}\right)\tan\theta \tag{1}$$

with the subscript "1" corresponding here, and in the rest of the text, to the diffuser inlet, the equation for the diffuser width being $$W = W_1 + 2\Delta x \tan\theta \tag{2}$$

For a distance from diffuser inlet of $\Delta x = 0.5\ W_1$ equation (1) becomes $$\frac{A}{A_1} = \frac{W}{W_1} = 1 + \tan\theta \tag{3}$$

For annular diffusers use is made of the corresponding two-dimensional straight-wall diffuser angle $\theta_{EFF}$ which is defined by equation $$\frac{A}{A_1} = 1 + \frac{\Delta A}{A_1} = 1 + 2\left(\frac{\Delta x}{h_1}\right)\tan\theta_{EFF} \tag{4}$$

where letter $h_1$ refers to the height of the diffuser at inlet and $\Delta A = A - A_1$. In literature symbol $\Delta R_1$ is often used in place of $h_1$.

Uniform and Incompressible Flow

Tests results reported in reference 4 by Sovran at al. and in reference 7 show that in annular diffusers having straight axes and uniform incompressible flow at inlet at high Reynolds numbers the optimal performance at a distance of $\Delta x = 0.5\ h_1$ from inlet occurs when the ratio of the cross-sectional area at that location to the inlet area $A/A_1$ is 1.10, that is, the optimal cross-sectional area increase is $(\Delta A/A)_{OPT} = 0.10$. Such diffuser geometry results in the largest allowable pressure gradient which the diffuser can sustain in the inlet region without permanent flow separation from the walls. From equation (4) it follows that the optimal corresponding two-dimensional straight-wall diffuser angle $\theta_{EFF}$ is 5.71 degrees.

For an incompressible and uniform flow, the Continuity Equation, which represents the Law of Conservation of Mass, applied to the control volume bounded by the diffuser inlet section 1, section 2, and the walls, shown in FIG. 5 results in the following expression for the flow velocity at section 2

$$U_{2,UF} = U_{1,UF}\frac{W_1}{W_2} = \frac{U_{1,UF}}{1 + 2\left(\frac{\Delta x}{W_1}\right)\tan\theta} \tag{5}$$

where subscript "UF" refers to the uniform flow conditions.

Defining a diffusion coefficient as $$C_P = \frac{P_2 - P_1}{\left(\frac{\rho U^2}{2}\right)_1} \tag{6}$$

the following equation can be written for the total pressure loss coefficient in the diffuser with uniform flow $$\begin{aligned}\left(\frac{\Delta P_t}{\rho U_1^2/2}\right)_{UF} &= \left(\frac{P_1 - P_2}{\rho U_1^2/2}\right)_{UF} + 1 - \left(\frac{U_2}{U_1}\right)^2_{UF} \\ &= -(C_P)_{UF} + 1 - \frac{1}{\left(1 + 2\frac{\Delta x}{W_1}\tan\theta\right)^2}\end{aligned} \tag{7}$$

where $\rho$ denotes fluid density.

The (linear) Momentum Equation in the x-direction, applied to the same control volume, reads $$\begin{aligned}\rho(U_{1,UF})^2 W_1 + \rho(U_{2,UF})^2 W_2 = P_1 W_1 - P_{2,UF} W_2 + \\ \frac{1}{2}(P_1 + P_{2,UF})(W_2 - W_1) + \\ F_{x,SHEAR,UF}\end{aligned} \tag{8}$$

where the term $F_{x,SHEAR}$ represents the x-component of the viscous shearing force acting on diffuser walls. Making use of equation (5) it transforms into the following equation for the diffusion coefficient $$\begin{aligned}(C_p)_{UF} &= \left(\frac{P_2 - P_1}{\rho U^2/2}\right)_{UF} \\ &= \frac{4\frac{\Delta x}{W_1}\tan\theta}{\left(1 + 2\frac{\Delta x}{W_1}\tan\theta\right)\left(1 + \frac{\Delta x}{W_1}\tan\theta\right)} +\end{aligned} \tag{9}$$

-continued $$\frac{2F_{x,SHEAR,UF}}{(\rho U_1^2/2)_{UF} W_1\left(1+\frac{W_2}{W_1}\right)}$$

The shearing force term can be written as $$\frac{2F_{x,SHEAR,UF}}{(\rho U_1^2/2)_{UF} W_1\left(1+\frac{W_2}{W_1}\right)} = -2\frac{C_f\frac{\Delta x}{W_1}}{1+\frac{\Delta x}{W_1}\tan\theta} \tag{10}$$

where $C_f$ denotes the mean skin friction coefficient for a turbulent boundary layer, which, for a representative Reynolds number based on distance of $5.4\times10^5$ has a value of, approximately, 0.0055. For $\Delta x=0.5\ W_1$ and $\theta=5.71$ degrees the shearing force term becomes equal to −0.005238, and equation (9) becomes $$(C_p)_{UF}=0.168 \tag{11}$$

which is the estimated optimal value of the diffusion coefficient for a uniform and incompressible flow in an annular diffuser whose length is $\Delta x=0.5h_1$ and whose cross-sectional area ratio is $A/A_1=1.10$, and $$\left(\frac{\Delta P_t}{\rho U_1^2/2}\right)_{UF} = 0.00555 \tag{12}$$

The effect of boundary layer blockage at diffuser inlet on the optimal value of the diffusion coefficient will not be considered here because, since we are concerned only with the effect of wakes on diffuser performance, only the knowledge of an approximate value of the optimal diffusion coefficient is required.

Effect of Wakes

FIG. 6 shows a drawing of a two-dimensional straight-wall diffuser with a wake at inlet. Meaning of terms used is indicated. Only one wake is shown and not all N wakes corresponding to N last turbine blades in order to clarify the description of the wakes.

For the velocity distribution in the wake we will use the following commonly-used expression (see, for example equation (4) in reference 1 by Hill et al.)

$$u = U\left[\left(1-\frac{\beta}{2}\right)-\left(\frac{\beta}{2}\right)\cos\frac{\pi y}{\delta}\right] \tag{13}$$

where u=free stream velocity u=flow velocity in the wake $\beta$=relative wake depth $(U-u_{min})/U$ y=distance coordinate perpendicular to the wake $\delta$=half-width of the wake $u_{min}$=smallest flow velocity in the wake Continuity Equation applied to the control volume bounded by the inlet and exit sections and the walls written for N wakes at diffuser inlet, where N denotes the number of the turbine last blades, and incompressible flow results in equation $$2N\int_0^{\delta_1} u_1 dy + (W_1-2N\delta_1)U_{1,W} = 2N\int_0^{\delta_2} u_2 dy + (W_2-2N\delta_2)U_{2,W} \tag{14}$$

from which the following equation for the free stream velocity at section 2 follows $$U_{2,W} = U_{1,W}\frac{1-\beta_1\left(\frac{N\delta_1}{W_1}\right)}{\left(1+2\frac{\Delta x}{W_1}\tan\theta\right)-\beta_2\left(\frac{N\delta_1}{W_1}\right)\left(\frac{\delta_2}{\delta_1}\right)} \tag{15}$$

The subscript "W" refers to the flow with wakes.

The (linear) Momentum Equation in the x-direction takes form $$\begin{aligned}&2N\rho\int_0^{\delta_2} u_2^2 dy + (W_2-2N\delta_2)\rho U_2^2 - \\ &\quad 2N\rho\int_0^{\delta_1} u_1^2 dy - (W_1-2N\delta_1)\rho U_1^2 = \\ &\quad P_1W_1 - P_2W_2 + \frac{1}{2}(P_1+P_2)(W_2-W_1) + F_{x,SHEAR,W}\end{aligned} \tag{16}$$

which yields the following equation for the diffusion coefficient $$\begin{aligned}(C_p)_W &= \left(\frac{P_2-P_1}{\rho U_1^2/2}\right)_W = \left[\frac{8\left(\frac{N\delta_1}{W_1}\right)\left(\frac{\delta_2}{\delta_1}\right)\left(1-\frac{3}{8}\beta_2\right)\beta_2 - 4\left(\frac{W_2}{W_1}\right)}{1+\frac{W_2}{W_1}}\right] \\ &\quad \frac{\left[1-\beta_1\left(\frac{N\delta_1}{W_1}\right)\right]^2}{\left[\left(1+2\frac{\Delta X}{W_1}\tan\theta\right)-\beta_2\left(\frac{N\delta_1}{W_1}\right)\left(\frac{\delta_2}{\delta_1}\right)\right]^2} - \\ &\quad \frac{\left[8\left(\frac{N\delta_1}{W_1}\right)\left(1-\frac{3}{8}\beta_1\right)\beta_1 - 4\right]}{1+\frac{W_2}{W_1}} + \frac{2F_{x,SHEAR,W}}{(\rho U_1^2/2)_W W_1\left(1+\frac{W_2}{W_1}\right)}\end{aligned} \tag{17}$$

Subtracting equation (9) from equation (17) assuming that the dimension-less shearing force at the walls term for the flow with wakes is the same as for the uniform flow, we obtain the following equation for the diffusion coefficient in a flow with wakes $$\begin{aligned}(C_p)_W &= (C_p)_{UF} + \\ &\quad \frac{\left[4\left(\frac{N\delta_1}{W_1}\right)\left(\frac{\delta_2}{\delta_1}\right)\left(1-\frac{3}{8}\beta_2\right)\beta_2 - 2\left(1+2\frac{\Delta X}{W_1}\tan\theta\right)\right]\left[1-\beta_1\left(\frac{N\delta_1}{W_1}\right)\right]^2}{\left(1+\frac{\Delta x}{W_1}\tan\theta\right)\left[\left(1+2\frac{\Delta X}{W_1}\tan\theta\right)-\beta_2\left(\frac{N\delta_1}{W_1}\right)\left(\frac{\delta_2}{\delta_1}\right)\right]^2} - \\ &\quad \frac{4\left(\frac{N\delta_1}{W_1}\right)\left(1-\frac{3}{8}\beta_1\right)\beta_1 - 2}{1+\frac{\Delta x}{W_1}\tan\theta} - \frac{4\frac{\Delta x}{W_1}\tan\theta}{\left(1+2\frac{\Delta x}{W_1}\tan\theta\right)\left(1+\frac{\Delta X}{W_1}\tan\theta\right)}\end{aligned} \tag{18}$$

The assumption made in the derivation of the last equation is acceptable because the wakes when they are deep affect only a small fraction of the diffuser walls, and when they are shallow the smallest velocity in them has magnitude not much different from that of the free stream.

Equation for the average total pressure loss coefficient for the flow with wakes can be written as $$\left(\frac{\Delta P_t}{\rho U_1^2/2}\right)_W = -(C_p)_W + \frac{1-2\left(\frac{N\delta_1}{W_1}\right)}{1-\left(\frac{N\delta_1}{W_1}\right)\beta_1} + \left(1-\beta_1+\frac{3}{8}\beta_1^2\right)\frac{\left(\frac{N\delta_1}{W_1}\right)(2-\beta_1)}{1-\left(\frac{N\delta_1}{W_1}\right)\beta_1} - \left(\frac{U_2}{U_1}\right)_W^2\left[\frac{1-2\left(\frac{N\delta_1}{W_1}\right)\left(\frac{W_1}{W_2}\right)\frac{\delta_2}{\delta_1}}{1-\left(\frac{N\delta_1}{W_1}\right)\left(\frac{W_1}{W_2}\right)\frac{\delta_2}{\delta_1}\beta_2} + \left(1-\beta_2+\frac{3}{8}\beta_2^2\right)\frac{\left(\frac{N\delta_1}{W_1}\right)\left(\frac{W_1}{W_2}\right)\left(\frac{\delta_2}{\delta_1}\right)(2-\beta_2)}{1-\left(\frac{N\delta_1}{W_1}\right)\left(\frac{W_1}{W_2}\right)\left(\frac{\delta_2}{\delta_1}\right)\beta_2}\right] \tag{19}$$

For two-dimensional turbulent wakes $\delta \sim \sqrt{x}$ and $\beta \sim 1\sqrt{x}$ (see: F. M. White: Viscous Fluid Flow, McGraw-Hill Book Company, 1974, p. 511, and H. Schlichting, McGraw-Hill Book Company, 7th edition, 1979, p. 734). As a result, $$\frac{\delta_2}{\delta_1} = \sqrt{1+\frac{\Delta x}{x_1}} \tag{20}$$

and $$\frac{\beta_2}{\beta_1} = \frac{1}{\sqrt{1+\frac{\Delta x}{x_1}}} \tag{21}$$

where $x_1$ denotes the distance measured from the point of formation of wakes to diffuser inlet, which in turbines represents the average distance from the trailing edges of last blades to diffuser inlet. We will take as a representative value $\Delta x/x_1=10$, for which $$\frac{\delta_2}{\delta_1} = 3.32 \tag{22}$$

and $$\frac{\beta_2}{\beta_1} = 0.30 \tag{23}$$

Two types of wakes are of interest when analyzing a flow in steam turbine diffusers: thick wakes which form when the condenser pressure is higher than the design value and the flow separates from last stage blades as a result of a large incidence angle which is then created at the inlet to the blades, and thin wakes which form when the condenser pressure is close to the design value and when, as a result, no separation of flow from (well-designed) last blades takes place. When thick wakes form the flow Mach number at diffuser inlet is only moderately high. Thin wakes form at the design conditions at which the flow Mach number at diffuser inlet is quite high, usually not far from unity.

For thin wakes we will take $N\delta_1/W_1=0.05$ which means that the wakes at diffuser inlet extend to 10 percent of the flow area there since the wake thickness is 26. This value corresponds very closely to that of the wake which forms in the flow at the exit of a 26-inch last stage steam turbine blade at design conditions whose photograph is shown in FIG. 17 of reference 9 (with $W_1$ corresponding to the N spaces between the blades, or blade spacings). The value of $N\delta_1/W_1=0.05$ is in good agreement with the calculated turbulent boundary layer thickness for average spacings between the last steam turbine blades. The thick wakes at diffuser inlet, which form from separated flow on the turbine last blades, can be expected to be at least twice as thick as the thin wakes, that is $N\delta_1/W_1 \cong 0.10$ for them.

For the flow with thick wakes, with $N\delta_1/W_1=0.10$, for $\Delta x/h_1=0.5$, with $\beta_1=0.8$, $\beta_2=0.24$, $\delta_2/\delta_1=3.32$, and the required value of the diffusion coefficient for a separation-free flow at optimum performance $(C_p)_w=0.168$, equations (9) and (18) are satisfied for the angle $\theta=4.0$ degrees, at which $(C_p)_{UF}=0.121$. This result indicates that in this case the wakes contribute 0.168–0.121=0.047, or 28%, to the diffusion coefficient and to the pressure gradient. The total pressure loss coefficient, obtained from equation (19), is 0.00704, which can be compared to the value of 0.005242 for uniform flow obtained from equation (7).

For the flow with thin wakes, with $N\delta_1/W_1=0.05$, $\Delta x/h_1=0.5$, $\beta_1=0.8$, $\beta_2=0.30\beta_1=0.24$ and $\delta_2/\delta_1=3.32$ for the required value of the diffusion coefficient for a separation-free flow at optimum performance $(C_p)_w=0.168$, equations (9) and (18) are satisfied for the angle $\theta=4.9$ degrees, at which $(C_p)_{UF}=0.146$. This result indicates that in this case the wakes contribute 0.168–0.146=0.022, or 13 percent to the diffusion coefficient and to the pressure gradient. The total pressure loss coefficient, obtained from equation (19) is 0.005902, which can be compared to the value of 0.005297 for a uniform flow obtained from equation (7).

The above results were obtained for a two-dimensional straight-wall diffuser having its wall angle equal to the corresponding two-dimensional straight-wall diffuser angle of an annular diffuser $\theta=\theta_{EFF}=5.71$ degrees, which corresponds to the annular diffuser optimal area ratio $A/A_1=1.10$ at $\Delta x=0.5\ h_1$ for a uniform and incompressible flow at the inlet and thus represent an acceptable estimate for the optimal conditions in the annular diffuser. The calculations were made so as to ensure that the results obtained are conservative. For the ratio $\Delta x/x_1$ a value of 10 was used although a smaller value would also be appropriate. Similarly, the value of $\beta_1$ was chosen to be 0.8 although it may well be closer to 1.0 especially for the thick wakes. Both of these choices make the calculated allowable diffuser cross-sectional area increases larger than they would be otherwise.

And so we have found that for an incompressible flow in an annular diffuser, at a distance $\Delta x=0.5\ h_1$, the optimal performance corresponds to the following: for a uniform flow at inlet $$\frac{\Delta A}{A_1} = 0.10 \text{ or } \frac{A}{A_1} = 1.10,\ \theta_{EFF} = 5.71°,\ C_p = (C_p)_{OPT} \cong 0.168$$

for a flow with thick wakes (with $C_p=(C_p)_{OPT}=0.168$)

$$\theta_{EFF} = 4.0° \text{ and } \frac{\Delta A}{A_1} = \tan 4.0° = 0.070, \text{ or } \frac{A}{A_1} = 1.070$$

indicating that a 30 percent reduction of the diffuser cross-sectional area increase is required to ensure an optimal performance flow without a permanent separation when compared with a uniform flow.

For a flow with thin wakes (with $C_p=(C_p)_{OPT}=0.168$)

$$\theta_{EFF} = 4.9° \text{ and } \frac{\Delta A}{A_1} = \tan 4.9° = 0.0857, \text{ or } \frac{A}{A_1} = 1.0857$$

indicating a 14.3 percent reduction of the diffuser cross-sectional area increase required to ensure an optimal performance flow without a permanent separation when compared with a uniform flow. Subscript "OPT" refers to the optimal diffusion conditions.

Effect of Compressibility

Tests have shown that in a subsonic flow, the compressibility of the fluid, that is, the flow Mach number, has no significant measurable effect on the value of the optimal diffusion coefficient, (refer, for example, to FIG. 21 in Creare Technical Note TN-186 of May 1975 entitled Diffuser Data Book by P. W. Runstadler, Jr., F. X. Dolan, and R. C. Dean, Jr.). For that reason the previous results obtained for an incompressible flow with the diffusion coefficient $(C_p)_{OPT,INC}$=0.168 can be used when applying a correction for compressibility. The subscript "INC" refers to an incompressible flow, for which the flow Mach number M=0.

To account for the effect of compressibility of steam we will use equation $$\frac{\Delta A}{A_1} = (1 - M^2)\left(\frac{\Delta A}{A_1}\right)_{INC} \tag{24}$$

for the (relative) diffuser cross-sectional area change. This method of correcting for compressibility is based on the following equation which relates changes of the flow area to the changes of pressure in a flow without losses which can be applied to a fluid like the wet steam in the exhaust flow diffusers $$\frac{dA}{A} = (1 - M^2)\frac{dP}{\rho U^2} \tag{25}$$

taken from reference 10 (equation 6–8 on page 201).

Equation (24) was derived from equation (25) by forming a ratio for two flows, one compressible and one incompressible, in which the total pressure losses are very small and in which the same fraction of the diffusion coefficient is produced by diffuser cross-sectional area change (the other fraction of the diffusion coefficient resulting from the process of decay of wakes).

At relatively high condenser pressures, of the order of 4.0 inches of mercury (absolute), at which the wakes entering the diffuser are thick because of flow separation from the turbine last blades, the average flow Mach number is usually about 0.5. It is this value that will be use when evaluating the effect of compressibility of steam at high condenser pressures.

Making use of equation (24) we find that for a compressible flow the (relative) diffuser cross-sectional area increase required to achieve optimal diffuser performance (which occurs in a flow still free of permanent separation) at $\Delta x=0.5\ h_1$ is as follows:

Flow with thick wakes, with the inlet flow Mach number $M_1$=0.5

$$\frac{\Delta A}{A_1} = [1 - (0.5)^2] \times 0.070 = 0.0525, \text{ or } \left(\frac{A}{A_1}\right)_{OPT} = 1.053$$

Flow with thin wakes, with the inlet flow Mach number $M_1$=0.9

$$\frac{\Delta A}{A_1} = [1 - (0.9)^2] \times 0.0857 = 0.0163, \text{ or } \left(\frac{A}{A_1}\right)_{OPT} = 1.016$$

Another method which an be used to account for the effect of compressibility is one which assumes that the wet steam in the diffuser behaves like an ideal gas having the ratio of specific heats, γ, which, for wet steam is approximately 1.1. Writing the expression for the portion of the diffusion coefficient which comes from diffuser cross-sectional area change in the form $$C_p = \frac{\left(\frac{P}{P_t}\right)\left(\frac{P_t}{P_{tl}}\right) - \left(\frac{P}{P_t}\right)_1}{\left(\frac{\rho U^2}{2P_t}\right)_1} \tag{26}$$

with $$\frac{P_t}{P_{tl}} = 1 - \frac{\Delta P_t}{P_{tl}} = 1 - \frac{\Delta P_t}{(\rho U^2/2)_1}\left(\frac{\rho U^2}{2P_t}\right)_1 \tag{27}$$

and with $$\frac{A}{A_1} = \left(\frac{A}{A_*}\right)\left(\frac{A_{*1}}{A_1}\right)\left(\frac{A_*}{A_{*1}}\right) \tag{28}$$

where $A_*$ denotes the critical flow area at which the flow Mach number M=1.0, with $$\frac{A_*}{A_{*1}} = \frac{P_{tl}}{P_t}$$

valid for flows in which the total enthalpy is constant because the critical mass flow rates for states 1 and 2 are the same, (refer to equation on page 205 of reference 10), we can determine the optimal area ratio $A/A_1$ at $\Delta x=0.5\ h_1$.

For the inlet flow Mach number $M_1$=0.5, $C_p$=0.121 (which represents the contribution to the diffusion coefficient $(C_p)_w$=0.168 coming from diffuser area change), and $\Delta P_t/(\rho U^2/2)_1$= 0.00704, equation (26) yields $$\left(\frac{A}{A_1}\right)_{OPT} = \frac{1.435}{1.365 \times 0.99915} = 1.052$$

which should be compared to the value of 1.053 obtained using equation (24).

It is also of interest to note that if the diffuser inlet flow were uniform, that is, if there were no wakes present, then the optimal diffuser cross-sectional area increases would have been much larger. For example, for $\Delta x=0.5h_1$ and $M_1$=0.5 the optimal area ratio would be $(A/A_1)_{OPT}=1+[1-(0.5)^2]\times 0.10=1.075$ and not 1.053. (To the area ratio of 1.075 corresponds angle $\theta_{EFF}$=4.3 degrees, while to the area ratio of 1.053 corresponds angle $\theta_{EFF}$=2.9 degrees.)

Recommendations

It is recommended, therefore, that the criterion for the prevention of flow separation and for optimal performance of annular exhaust flow diffusers of condensing steam turbines be $$\frac{A}{A_{INLET}} \leq 1.05 \tag{29}$$

at a distance of one half of diffuser inlet height measured along the diffuser mean line, or that the corresponding two-dimensional straight-wall diffuser angle, obtained from equation (4) be limited to $$\theta_{EFF} \leqq 2.9° \tag{30}$$

with the rate of cross-sectional area increase at larger distances corresponding mainly to the optimal rate determined for an incompressible uniform flow corrected for the effect of compressibility.

The analysis indicates that at condenser pressures approaching the design values, at which the flow Mach number at diffuser inlet is high and approaches unity, the allowable rate of increase of cross-sectional area in the initial portion of the diffuser becomes much smaller than at the lower flow Mach numbers.

For diffusers having fixed cross sections, to address the usual steam turbine operating conditions which cause the flow Mach number at the exhaust flow diffuser inlet to vary, such as the changing condenser pressure which may be related to changes in turbine load or to changes in cooling water temperature, one should choose the initial rate of increase of the diffuser cross-sectional area so that it satisfies the design criterion which takes into account the diffusion produced by the decay of wakes as well as the effect of compressibility of steam. Such criterion is represented by the inequality (29) which should be satisfied at a distance of one half of diffuser inlet height measured along the diffuser mean line.

The detrimental effect of changing steam turbine operating conditions can be addressed by the use in turbines of diffusers utilizing adjustable guide vanes. In such diffusers the cross-sectional areas can be changed in response to changing turbine operating conditions. These diffusers should be so designed that the cross-sectional area increases in their initial portions can be varied from very small to the value determined by this analysis and represented by the inequality (29) at a distance of one half of diffuser inlet height measured along the diffuser mean line for most of the travel path of the adjustable guide vane.

I claim:

1. An annular diffuser at the exit of a multistage low-pressure condensing steam turbine, the design of which diffuser alleviates flow separation in such diffuser defined by an outer flow guide and an inner flow guide, and in which at a distance of one half of the diffuser height at its inlet measured along the mean line from the inlet the cross-sectional area increase is not larger than 5.0% of the cross-sectional area at the inlet for most of the annular diffuser's circumference.

2. The annular diffuser of claim 1 in which the outer flow guide has at its beginning a radius of curvature larger than or equal to one half of the length of the last blades of the turbine.

3. The annular diffuser of claim 2 in which a tangent drawn with respect to the outer flow guide at its beginning is horizontal.

4. The annular diffuser of claim 1 in which the length of the diffuser measured along a mean line is equal to or larger than 90% of the length of the last blades of the turbine for at least most of the circumference of the diffuser.

5. The annular diffuser of claim 4 in which a portion of the diffuser is formed of one or more adjustable guide vanes.

6. An annular diffuser at the exit of a low-pressure condensing steam turbine, which diffuser alleviates flow separation in the diffuser, defined by the outer flow guide and the bearing cone, in which at a distance of one half of the diffuser height at its inlet measured along the mean line from the inlet the corresponding two-dimensional straight-wall diffuser angle is 2.9 degrees or less for most of its circumference.

7. The annular diffuser of claim 6 in which the flow guide which defines the diffuser's outer surface has at its beginning a radius of curvature larger than or equal to one half of the length of the last blades of the turbine.

8. The annular diffuser of claim 7 in which a tangent to the outer flow guide at its beginning is horizontal.

9. An annular diffuser at the exit of a multistage low-pressure condensing steam turbine, which diffuser discourages flow separation in the diffuser, defined by an outer flow guide and at least in part by an adjustable guide vane surrounding at least a portion of a bearing cone, in which at a distance of one half of the diffuser height at its inlet measured along the mean line from the inlet the cross-sectional area increase of the diffuser is not larger than 5.0% of the cross-sectional area at the inlet for most of its circumference for most of the travel path of the adjustable guide vane.

10. The annular diffuser of claim 9 in which the flow guide which defines the diffuser's outer surface has at its beginning a radius of curvature larger than or equal to one half of the length of the last blades of the turbine.

11. The annular diffuser of claim 10 in which a tangent drawn to the outer flow guide at its beginning is horizontal.

12. The annular diffuser of claim 9 in which the length of the diffuser measured along a mean line is equal to or larger than 90% of the length of the last blades of the turbine for most of its circumference.

13. An annular diffuser at the exit of a multistage low-pressure condensing steam turbine, defined by an outer flow guide and at least in part by an adjustable guide vane surrounding at least a portion of a bearing cone, in which at a distance of one half of the diffuser height at its inlet measured along the mean line from the inlet the corresponding two-dimensional straight-wall diffuser angle is 2.9 degrees or less for most of the diffuser's circumference and for most of the travel path of the adjustable guide vane.

14. The annular diffuser of claim 13 in which the flow guide which defines its outer extent has at its beginning a radius of curvature larger than or equal to one half of the length of the last blades of the turbine.

15. The annular diffuser of claim 14 in which a tangent to the outer flow guide drawn at the beginning of the flow guide is horizontal.

16. An annular diffuser at the exit of a multistage low-pressure condensing steam turbine, defined by an outer flow guide and at least in part by an adjustable guide vane surrounding at least a portion of the bearing cone, in which at a distance of one half of the diffuser height at its inlet measured along the mean line from the inlet the cross-sectional area increase is not larger than 5.0% of the cross-sectional at inlet for most of its circumference when the adjustable guide vane is in position closest to the turbine's last blades.

17. An annular diffuser at the exit of a multistage low-pressure condensing steam turbine, defined by an outer flow guide and at least in part by the adjustable guide vane surrounding at least a portion of the bearing cone, in which at a distance of one half of the diffuser height at its inlet measured along the mean line from the inlet the corresponding two-dimensional straight-wall diffuser angle is 2.9 degrees or less for most of its circumference when the adjustable guide vane is in position closest to the turbine last blades.

18. An annular diffuser at the exit of a multistage low-pressure condensing steam turbine, which diffuser alleviates flow separation in the diffuser wherein the length measured along the mean line for most of its circumference is less than 150% of the length of the turbine blades, in which at a distance of half of the diffuser height at its inlet measured along the same mean line from the inlet the cross-sectional area increase is not higher than 5.0% of the cross-sectional area at inlet for most of its circumference.

19. An annular diffuser at the exit of a multistage low-pressure condensing steam turbine, defined by an outer flow guide and an inner flow guide, in which at a distance of one half of the diffuser height at inlet measured along the mean line from its inlet the cross-sectional area increase is not larger than 4.0% of the cross-sectional area at inlet for most of the annular diffuser's circumference.

20. An annular diffuser at the exit of a multistage low-pressure condensing steam turbine, defined by the outer flow guide and an inner flow guide, in which at a distance of one half of the diffuser height at inlet measured along the mean line from its inlet the corresponding two-dimensional straight-wall diffuser angle is 2.3 degrees or less for most of its circumference.

21. An annular diffuser at the exit of a multistage low-pressure condensing steam turbine, defined by an outer flow guide and an inner flow guide, in which at a distance of one half of the diffuser inlet height at inlet measured along the mean line from its inlet the cross-sectional area increase is not larger than 3.0% of the cross-sectional area at inlet for most of the annular diffuser's circumference.

22. An annular diffuser at the exit of a multistage low-pressure condensing steam turbine, defined by the outer flow guide and an inner flow guide, in which at a distance of one half of the diffuser height at inlet measured along the mean line from its inlet the corresponding two-dimensional straight-wall diffuser angle is 1.7 degrees or less for most of its circumference.

* * * * *

UNITED STATES PATENT AND TRADEMARK OFFICE

CERTIFICATE OF CORRECTION

PATENT NO. : 6,261,055 B1
DATED : July 17, 2001
INVENTOR(S) : Jerzy A. Owczarek

It is certified that error appears in the above-identified patent and that said Letters Patent is hereby corrected as shown below:

Column 1,
Line 28, add -- by -- after "in some cases".

Column 3,
Line 18, "Deich" should read -- Deych --.
Line 64, "Deich" should read -- Deych --.

Column 7,
Line 25, omit "v" after "one half of".

Column 10,
Line 48, add "=", between "$\theta_{EFF}$" and "21 degrees".

Column 11,
Line 56, change "20" to -- $2_\theta$ -- after "be expected at".
Line 61, "Deich" should read -- Deych --.

Column 18,
Line 32, reinsert -- Although there are N wakes in the diffuser of a turbine, corresponding to N turbine last blades, only one is shown to allow clear description of the wakes. --

Column 20,
Line 22, add -- in general -- after "area".

Column 23,
Line 55, change "u" to -- U -- ahead of: = free stream velocity.

Column 24,
Line 29, move equation number (17) from line 29 to line 40.
Line 49, move equation number (18) from line 49 to line 57.

UNITED STATES PATENT AND TRADEMARK OFFICE

CERTIFICATE OF CORRECTION

PATENT NO. : 6,261,055 B1
DATED : July 17, 2001
INVENTOR(S) : Jerzy A. Owczarek

It is certified that error appears in the above-identified patent and that said Letters Patent is hereby corrected as shown below:

Column 25,
Line 2, move equation number (19) from line 2 to line 13.

Line 17, change $\delta \simeq \sqrt{x}$ to $\delta \sim \sqrt{x}$
to
change $\beta \simeq 1\sqrt{x}$ to $\beta \sim 1/\sqrt{x}$ Line 58, change "26" to -- $2_\delta$ --

Column 30,
Line 44, add -- area -- after "sectional" add -- the -- after "at"

Signed and Sealed this

Fourteenth Day of May, 2002

*Attest:*

*Attesting Officer*

JAMES E. ROGAN
*Director of the United States Patent and Trademark Office*